US008100732B2

(12) United States Patent
Nakamura et al.

(10) Patent No.: US 8,100,732 B2
(45) Date of Patent: Jan. 24, 2012

(54) BOAT PROPULSION UNIT

(75) Inventors: Daisuke Nakamura, Shizuoka (JP); Yoshihiko Okabe, Shizuoka (JP); Yoshihito Fukuoka, Shizuoka (JP); Masami Suzuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 328 days.

(21) Appl. No.: 12/468,977

(22) Filed: May 20, 2009

(65) Prior Publication Data

US 2009/0298362 A1 Dec. 3, 2009

(30) Foreign Application Priority Data

May 27, 2008 (JP) ..... 2008-137560

(51) Int. Cl.

| | |
|---|---|
| ***B63H 20/14*** | (2006.01) |
| ***B63H 20/20*** | (2006.01) |
| ***B63H 21/21*** | (2006.01) |
| ***B63H 23/30*** | (2006.01) |
| ***F16D 11/00*** | (2006.01) |
| ***F16D 21/00*** | (2006.01) |
| ***F16D 23/00*** | (2006.01) |
| ***F16H 3/00*** | (2006.01) |
| ***F16H 61/00*** | (2006.01) |

(52) U.S. Cl. ..... 440/75; 440/80; 440/86; 192/48.1; 192/48.7; 192/51

(58) Field of Classification Search ..... 440/75, 440/80, 86; 192/21, 48.1, 48.7, 51, 52.1, 192/70.21

See application file for complete search history.

(56) References Cited

U.S. PATENT DOCUMENTS

| | | | | |
|---|---|---|---|---|
| 5,888,108 | A | 3/1999 | Iriono | |
| 6,899,577 | B2 * | 5/2005 | Yasuda et al. | 440/86 |
| 7,704,183 | B2 * | 4/2010 | Nakamura et al. | 475/312 |

FOREIGN PATENT DOCUMENTS

| | | | |
|---|---|---|---|
| JP | 09-263294 | A | 10/1997 |
| WO | WO 2007007707 | A1 * | 1/2007 |

* cited by examiner

*Primary Examiner* — Ajay Vasudeva
(74) *Attorney, Agent, or Firm* — Keating & Bennett, LLP

(57) ABSTRACT

A boat propulsion unit minimizes a shock upon switching of an engagement state of a clutch mechanism. The boat propulsion unit includes an upper clutch mechanism that is arranged on an axis of a lower drive shaft and that can be switched between an engagement state (first engagement state) in which driving force of an engine is transmitted to a downstream side, and a half clutch state in which the driving force of the engine is reduced and then is transmitted; and an advance-reverse drive that is disposed on an axis of a front propeller drive shaft and a rear propeller drive shaft and that can be switched between a forward travel engagement state and a reverse travel engagement state (second disengagement state) in which the driving force of the engine is transmitted to a front propeller and a rear propeller in order to propel a boat, and a disengagement state (second disengagement state) in which the driving force of the engine is disengaged.

11 Claims, 18 Drawing Sheets

BOAT PROPULSION UNIT

BACKGROUND OF THE INVENTION

1. Field of the Invention

The present inventions relates to a boat propulsion unit, and more specifically to a boat propulsion unit including a clutch mechanism.

2. Description of the Related Art

A boat propulsion device (boat propulsion unit) including a clutch mechanism is conventionally known (see JP-A-Hei 9-263294, for example). JP-A-Hei 9-263294 discloses a boat propulsion unit that includes an engine, a drive shaft extending below the engine, and a dog clutch arranged below the drive shaft. The dog clutch is constructed to be able to switch an engagement state between a forward travel engagement state in which driving force of the engine can be transmitted to a propeller in order to propel the boat forward, and a reverse travel engagement state in which driving force of the engine can be transmitted to the propeller in order to reverse the boat. In the boat propulsion device according to JP-A-Hei 9-263294, the driving force of the engine is directly transmitted to the dog clutch via the drive shaft. Thus, the dog clutch can be switched between a forward travel engagement state and a reverse travel engagement state when driving force of the engine is transmitted.

However, in the boat propulsion device (water craft propulsion unit) disclosed in JP-A-Hei 9-263294, the dog clutch is switched to a forward travel engagement state or a reverse travel engagement state when the driving force of the engine is transmitted. Thus, there is a problem that a great shock is received by an operator upon switching of an engagement state of the dog clutch.

SUMMARY OF THE INVENTION

In order to overcome the problems described above, preferred embodiments of the present invention provide a boat propulsion unit that can reduce a shock received by the operator upon switching of an engagement state of the clutch mechanism.

A boat propulsion unit according to a preferred embodiment of the present invention includes: an engine; a drive shaft that is arranged below the engine; an output shaft that is arranged below the drive shaft and that extends in a direction intersecting with the drive shaft; a propeller that is disposed on the output shaft and rotated together with the output shaft; a first clutch mechanism that is arranged on an axis of the drive shaft, and that is constructed to be able to switch an engagement state between a first engagement state in which driving force of the engine is transmitted to the output shaft, and at least one of a half-engaged state in which part of driving force of the engine transmitted in a first engagement state is transmitted to the output shaft, and a first disengagement state in which driving force of the engine is completely disengaged; and a second clutch mechanism that is arranged on an axis of the output shaft, and that is constructed to be able to switch an engagement state between a second engagement state in which driving force of the engine is transmitted to the propeller in order to propel the boat forward and a second disengagement state in which driving force of the engine is disengaged.

As described above, the boat propulsion unit according to a preferred embodiment of the present invention preferably includes: the first clutch mechanism that can switch an engagement state between a first engagement state in which driving force of the engine is transmitted to the output shaft, and at least one of a half-engaged state in which a portion of the driving force of the engine is transmitted to the output shaft, and a first disengagement state in which driving force of the engine is completely disengaged; and the second clutch mechanism that can switch an engagement state between a second engagement state in which driving force of the engine is transmitted to the propeller in order to propel the boat forward, and a second disengagement state in which driving force of the engine is disengaged. Thus, the second clutch mechanism can be switched to a second engagement state when the first clutch mechanism is at least one of a half-engaged state and a first disengagement state. Accordingly, because the second clutch mechanism can be switched to a second engagement state in a state where the driving force of the engine is not transmitted to the second clutch, a shock upon switching of an engagement state of the second clutch mechanism can be reduced.

In the water propulsion unit according to the preferred embodiment described above, preferably, a second engagement state of the second clutch mechanism includes: a forward travel engagement state in which the driving force of the engine can be transmitted to the propeller in order to propel the boat forward; and a reverse travel engagement state in which the driving force of the engine can be transmitted to the propeller in order to reverse the boat. According to this construction, in a forward travel engagement state in which the second clutch mechanism allows the boat to travel forward, a shock upon switching of an engagement state of the second clutch mechanism can be reduced. In addition, in the reverse travel engagement state in which the second clutch mechanism reverses the boat, a shock upon switching of an engagement state of the second clutch mechanism can be reduced.

In the boat propulsion unit including a second clutch mechanism that can switch an engagement state between the forward travel engagement state and the reverse travel engagement state, preferably, when the first clutch mechanism is half-engaged, the second clutch mechanism can be switched to either the forward travel engagement state or the reverse travel engagement state. According to this construction, for example, in the case that the second clutch mechanism is includes clutches such as dog clutches that transmit driving force by engaging with each other, when the first clutch mechanism is half-engaged, and when the second clutch mechanism is controlled to switch an engagement state to either the forward travel engagement state or the reverse travel engagement state, switching operation of the second clutch mechanism is performed while the second clutch mechanism is driven to a position where the dog clutch is engaged. Thus, the second clutch mechanism can be smoothly engaged. When the first clutch mechanism is half-engaged, a shock upon engagement of the second clutch mechanism can be reduced substantially compared to a case in which the first clutch mechanism is completely engaged.

In the boat propulsion unit including the first clutch mechanism that can switch an engagement state to a half-engaged state in which a portion of the driving force of the engine is transmitted to the output shaft, preferably, the first clutch mechanism has a plurality of plate members, and includes a plate clutch that can switch an engagement state to a first engagement state or a half-engaged state when the plurality of plate members come in contact with each other, and the second clutch mechanism has a plurality of engagement portions, and include a dog clutch that can switch an engagement state to a second engagement state when the plurality of engaged portion are engaged. According to this construction, by providing the first clutch mechanism with a plate clutch that has a plurality of plate members and can switch an engagement state to a first engagement state or a half-engaged state when the plurality of plate members come in contact with each other, the first clutch mechanism can easily be engaged in a first engagement state or a half-engaged state. By providing the second clutch mechanism with a dog clutch that has a plurality of engagement portions and that can switch an engagement state to a second engagement state when the plurality of engagement parts are engaged, and by combining the second clutch mechanism and the first clutch mechanism that allows engagement in a first engagement state or a half-engaged state, the second clutch mechanism can be smoothly engaged into either a forward travel engagement state or a reverse travel engagement state.

In the boat propulsion unit that includes the first clutch mechanism that can switch an engagement state to a half-engaged state in which a portion of the driving force of the engine is transmitted to the output shaft, preferably a control unit is further included to control the second clutch mechanism so as to switch an engagement state to either a forward travel engagement state or a reverse travel engagement state when the first clutch mechanism is in either a first disengagement state or a half-engaged state. With this construction, when the first clutch mechanism is either in a first disengagement state or a half-engaged state, the control unit can electrically switch an engagement state to either a forward travel engagement state or a reverse travel engagement state.

In this case, preferably, the control unit is constructed such that when the first disengagement state in which the first clutch mechanism disengages driving force of the engine, and the second disengagement state in which the second clutch mechanism disengages driving force of the engine are both maintained for a certain period, the control unit performs control to switch the first clutch mechanism to be in the first engagement state after the elapse of the certain period. With this construction, because the first clutch mechanism is engaged in a first engagement state after the elapse of a certain period, the drive shaft can be prevented from stopping for a certain period or longer. Accordingly, a unit such as a water pump, which is driven by the drive shaft, can be prevented from being not driven for a certain period or longer.

Preferably, the boat propulsion unit according to the above preferred embodiment further includes a water pump that is arranged above an axis of the drive shaft, arranged below the first clutch mechanism, and driven when the driving force of the engine is transmitted by the first clutch mechanism. With this construction, the water pump can pump up cooling water from a position lower than the first clutch mechanism and closer to the water surface.

Preferably, the boat propulsion unit according to the above preferred embodiment further includes a transmission mechanism that can transmit the driving force of the engine that has been changed with at least a low speed reduction ratio or a high speed reduction ratio. Also, preferably, the first clutch mechanism is arranged below the transmission mechanism. With this construction, the boat propulsion unit that allows the first clutch mechanism to be arranged on the axis of the drive shaft can easily be obtained.

Preferably, in the boat propulsion unit according to the above preferred embodiment, the output shaft includes: a first output shaft that rotates in a first direction when the boat is propelled forward, and that rotates in a second direction that is opposite to the first direction when the boat is propelled in reverse; and a second output shaft that rotates in the second direction when the boat is propelled forward, and that rotates in the first direction when the boat is propelled in reverse. The propeller includes a first propeller that is disposed on the first output shaft and a second propeller that is disposed on the second output shaft, and the rotational directions of the first output shaft and the second output shaft upon forward travel or reverse travel of the boat are switched by the second clutch mechanism. With this construction, the present preferred embodiment can be applied to a boat propulsion unit of a contra-rotating propeller type that includes two propellers, a first propeller and a second propeller. Thus, a shock upon switching of an engagement state of the second clutch mechanism can be minimized in the boat propulsion unit of the contra-rotating propeller type.

Preferably, the boat propulsion unit according to the above preferred embodiment further includes a speed reduction member that is arranged near a bottom end of the drive shaft, and that is arranged to transmit the rotation of the drive shaft to the output shaft at a reduced speed. With this construction, the driving force of the engine can be transmitted to the output shaft in a state where the rotational speed of the drive shaft is reduced. In this case, the second clutch mechanism can be engaged into a second engagement state at a reduced rotational speed, so that a shock upon switching of the second clutch mechanism can also be reduced accordingly.

Other features, elements, arrangements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, a description will be provided of preferred embodiments of the present invention with reference to the drawings.

First Preferred Embodiment

Figure 1:
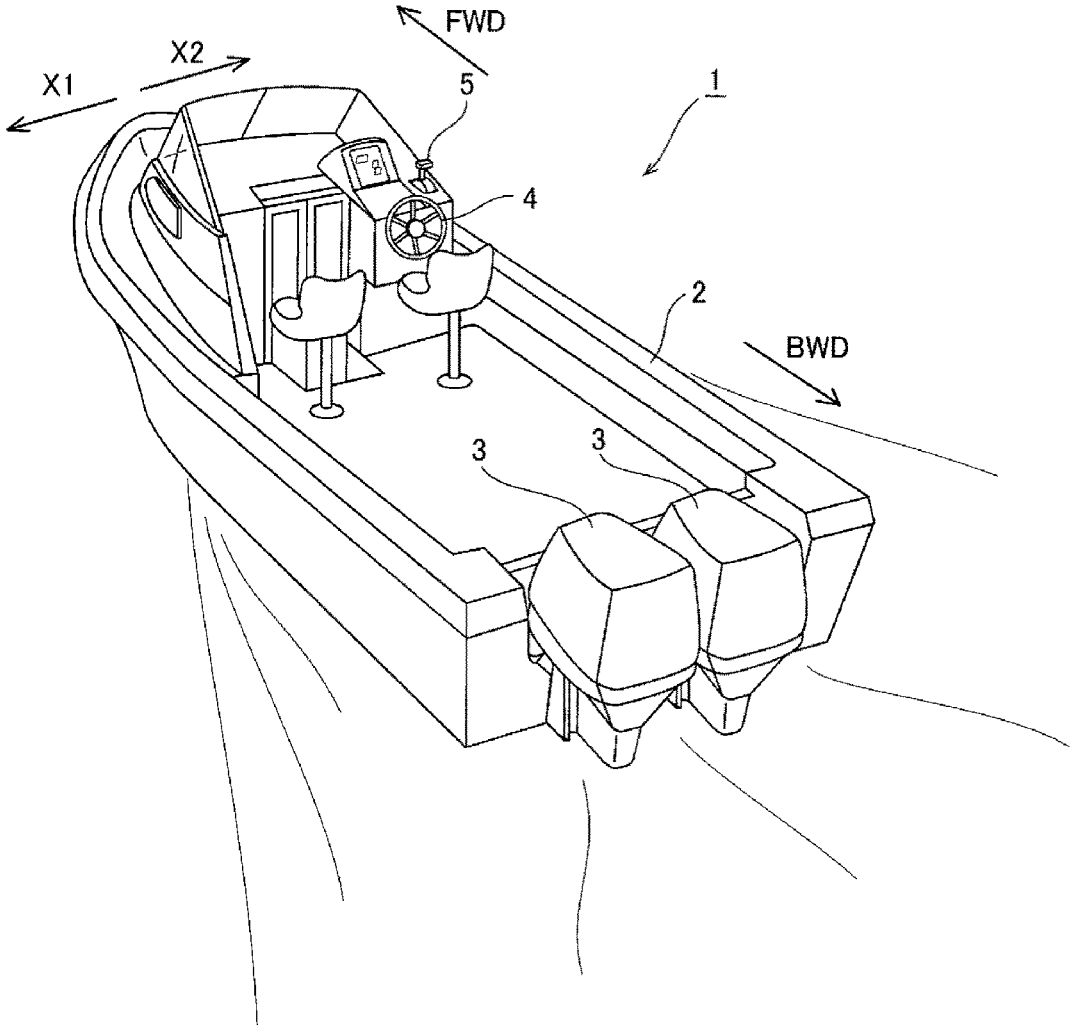
FIG. 1 is a perspective view showing a boat in which an outboard motor in accordance with a first preferred embodiment of the present invention is installed.

FIG. 1 is a perspective view showing a boat in which an outboard motor in accordance with a first preferred embodiment of the present invention is installed. FIG. 2 through FIG. 12 are drawings for specifically illustrating a construction of the outboard motor in accordance with the first preferred embodiment shown in FIG. 1. In the drawings, FWD denotes the forward direction of the boat while BWD denotes the backward direction of the boat. First, the construction of an outboard motor 3 that is installed in the boat 1 in accordance with the first preferred embodiment is described with reference to FIG. 1 through FIG. 12.

As shown in FIG. 1, the boat 1 in accordance with the first preferred embodiment has a hull 2 to be floated on water, two outboard motors 3 that are mounted on a rear portion of the hull 2 to propel the hull 2, a steering section 4 for steering the hull 2, a control lever 5 disposed in the vicinity of the steering section 4 and capable of turning the hull 2 in the fore-and-aft direction. The outboard motor 3 and the control lever 5 are examples of a "boat propulsion unit" according to a preferred embodiment of the present invention.

Figure 2:
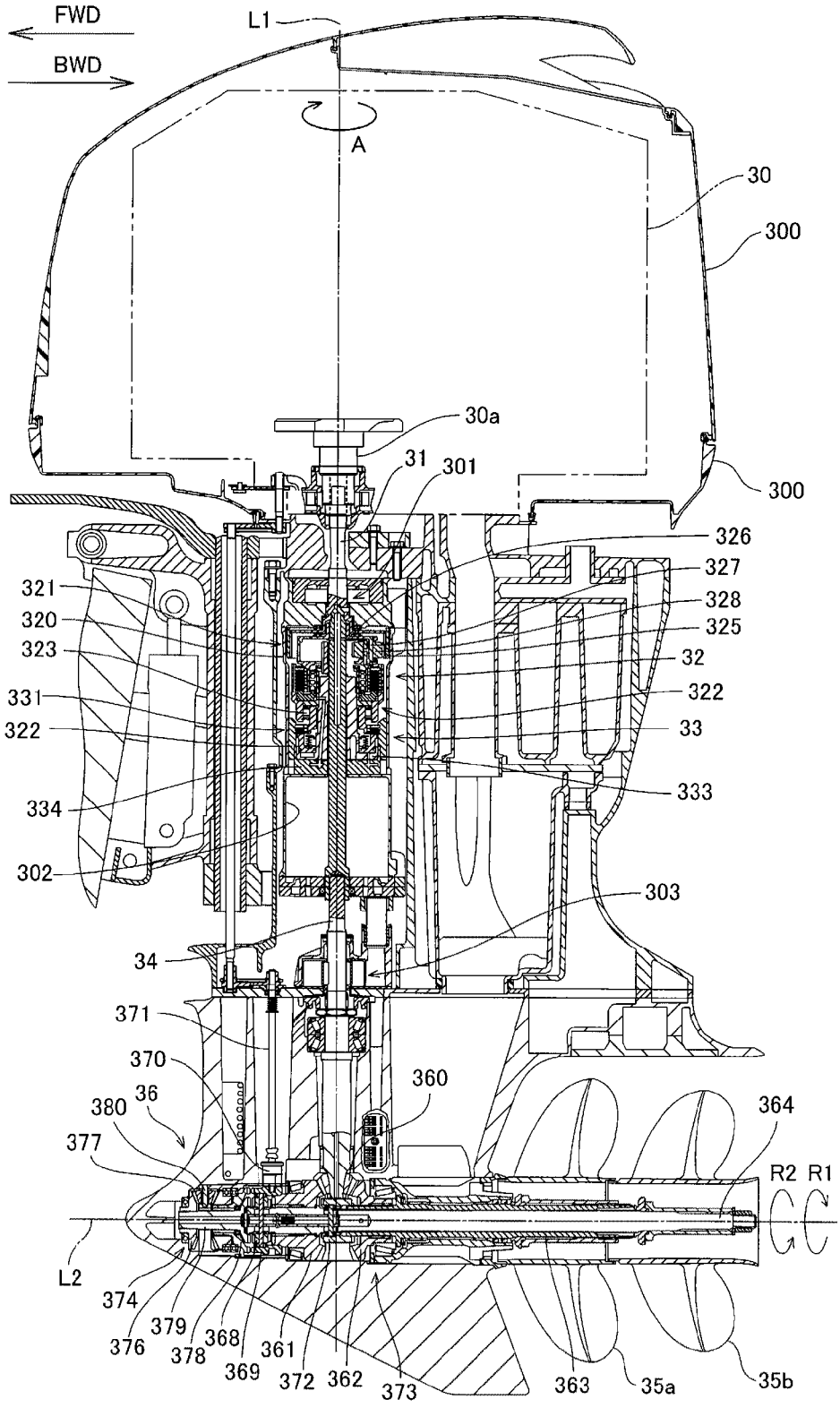
FIG. 2 is a cross-sectional view for explaining the construction of the outboard motor according to the first preferred embodiment shown in FIG. 1.

The two outboard motors 3 preferably are disposed symmetrically with respect to the center in the width direction of the hull 2 (in the arrow X1 direction and the arrow X2 direction). As shown in FIG. 2, the outboard motor 3 preferably includes: an engine 30; an upper drive shaft 31 that is arranged to extend downward from the engine 30 and to transmit the driving force of the engine 30; a transmission mechanism 32 arranged to change the driving force of the engine 30 transmitted to the upper drive shaft 31 with a low speed reduction ratio (about 1.3:1.0) or a high speed reduction ratio (about 1.0:1.0); and a upper clutch mechanism 33 that is arranged above an axis L1 of the upper drive shaft 31. The outboard motor 3 preferably further includes: a lower drive shaft 34 that is arranged to extend downward from the upper clutch mechanism 33; and a lower mechanism 36 arranged to transmit the driving force of the engine 30 transmitted to the lower drive shaft 34 to a front propeller 35*a* and a rear propeller 35*b*. The upper drive shaft 31 and the lower drive shaft 34 are examples of the "drive shaft" according to a preferred embodiment of the present invention. The front propeller 35*a* is an example of the "first propeller" and the "propeller" according to a preferred embodiment of the present invention, and the rear propeller 35*b* is an example of the "second propeller" and the "propeller" according to a preferred embodiment of the present invention. The outboard motor 3 is covered by a plurality of casings 300. The casings 300 preferably are formed of resin or metal and has a function to protect the inside of the outboard motor 3 against water and so forth.

Figure 3:
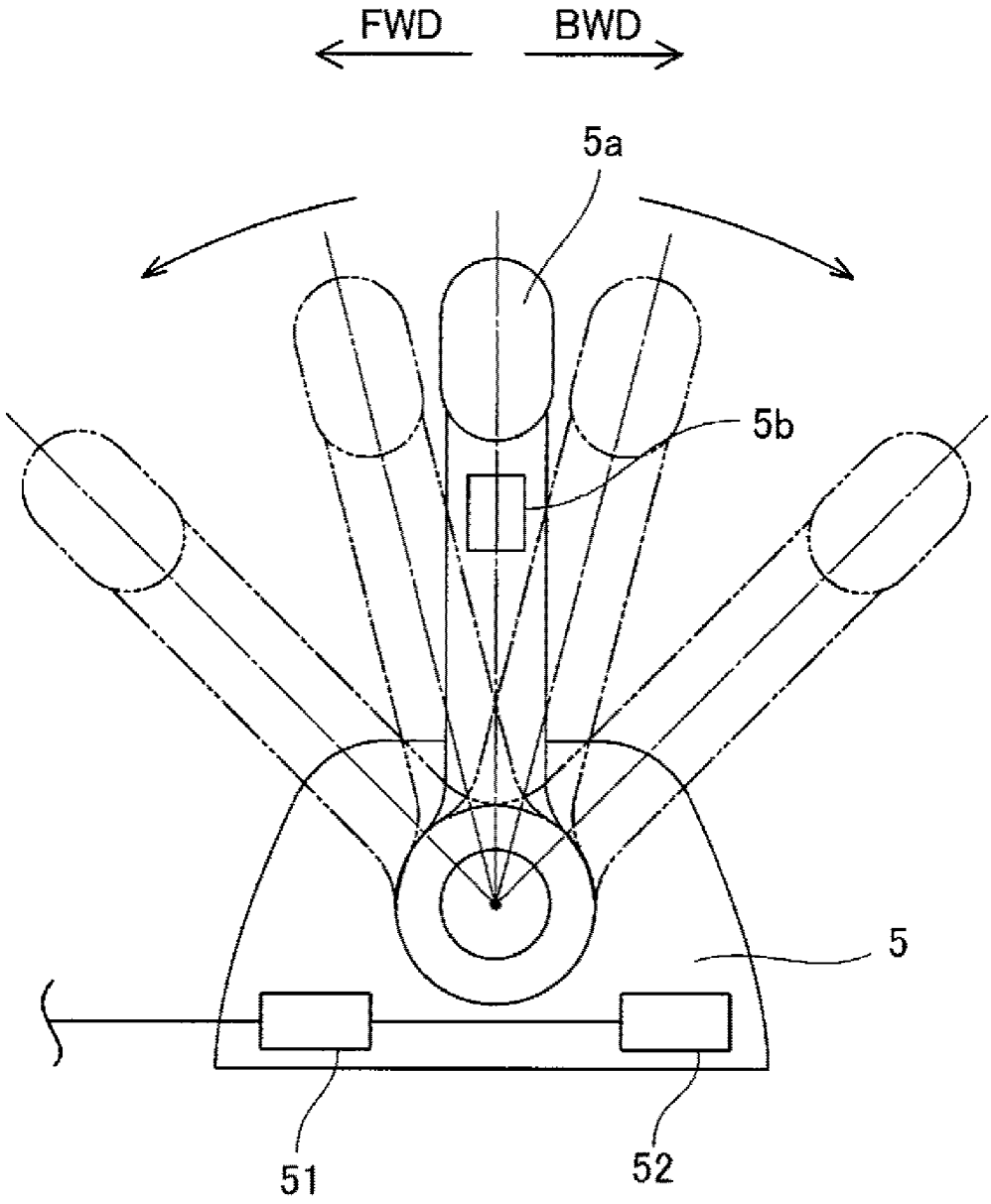
FIG. 3 illustrates the construction of the control lever of the outboard motor according to the first preferred embodiment shown in FIG. 1.

As shown in FIG. 3, the control lever 5 preferably includes: a control unit 51 arranged to control the upper clutch mechanism 33 (refer to FIG. 2) and an advance-reverse drive 373 (refer to FIG. 2) and a reverse travel drive 374 described later; and a shift position sensor 52, which detects a shift position of the lever 5*a*. The shift position sensor 52 has a function to detect a shift position of the lever 5*a* among neutral, forward, and rearward. When the lever 5*a* of the control lever 5 is turned forward (in the arrow FWD direction), and the shift position sensor 52 detects that the lever 5*a* is in front of a neutral position (in the arrow FWD direction), the control unit 51 controls the advance-reverse drive 373 and the reverse travel drive 374 (refer to FIG. 2) so as to propel the hull 2 (refer to FIG. 1) forward. When the lever 5*a* is turned to neither the front nor the rear, the control unit 51 controls the advance-reverse drive 373 and the reverse travel drive 374 (refer to FIG. 2) to be in a neutral state, in which the hull 2 (refer to FIG. 1) is propelled neither frontward nor rearward. When the lever 5*a* of the control lever 5 is turned to the rear (in the arrow BWD direction), and the shift position sensor 52 detects that the lever 5*a* is in the rear of a neutral position, the control unit 51 controls the advance-reverse drive 373 and the reverse drive 374 to propel the hull 2 (refer to FIG. 1) in reverse.

A selection button 5*b* is disposed on the lever 5*a* of the control lever 5. The selection button 5*b*, when pressed, transmits a signal to switch the ratio of the transmission mechanism 32 between a low speed reduction ratio and a high speed reduction ratio.

Now, structures of the engine 30, the transmission mechanism 32, and the upper clutch mechanism 33 are described. As shown in FIG. 2, the engine 30 is provided with a crankshaft 30*a* that rotates about the axis L1. The engine 30 generates driving force by the rotation of the crankshaft 30*a*. An upper portion of an upper drive shaft 31 is connected to the crankshaft 30*a*. The upper drive shaft 31 is arranged on the axis L1 and rotates about the axis L1 in the A direction in accordance with the rotation of the crankshaft 30*a* in the A direction.

An oil pump 301 is attached to the vicinity of the bottom of the upper drive shaft 31. The oil pump 301 pumps up the oil reserved in an oil pan 302, which is described later, and applies pressure to the oil in order to supply the pumped-up oil to certain portions in the outboard motor 3.

Figure 4:
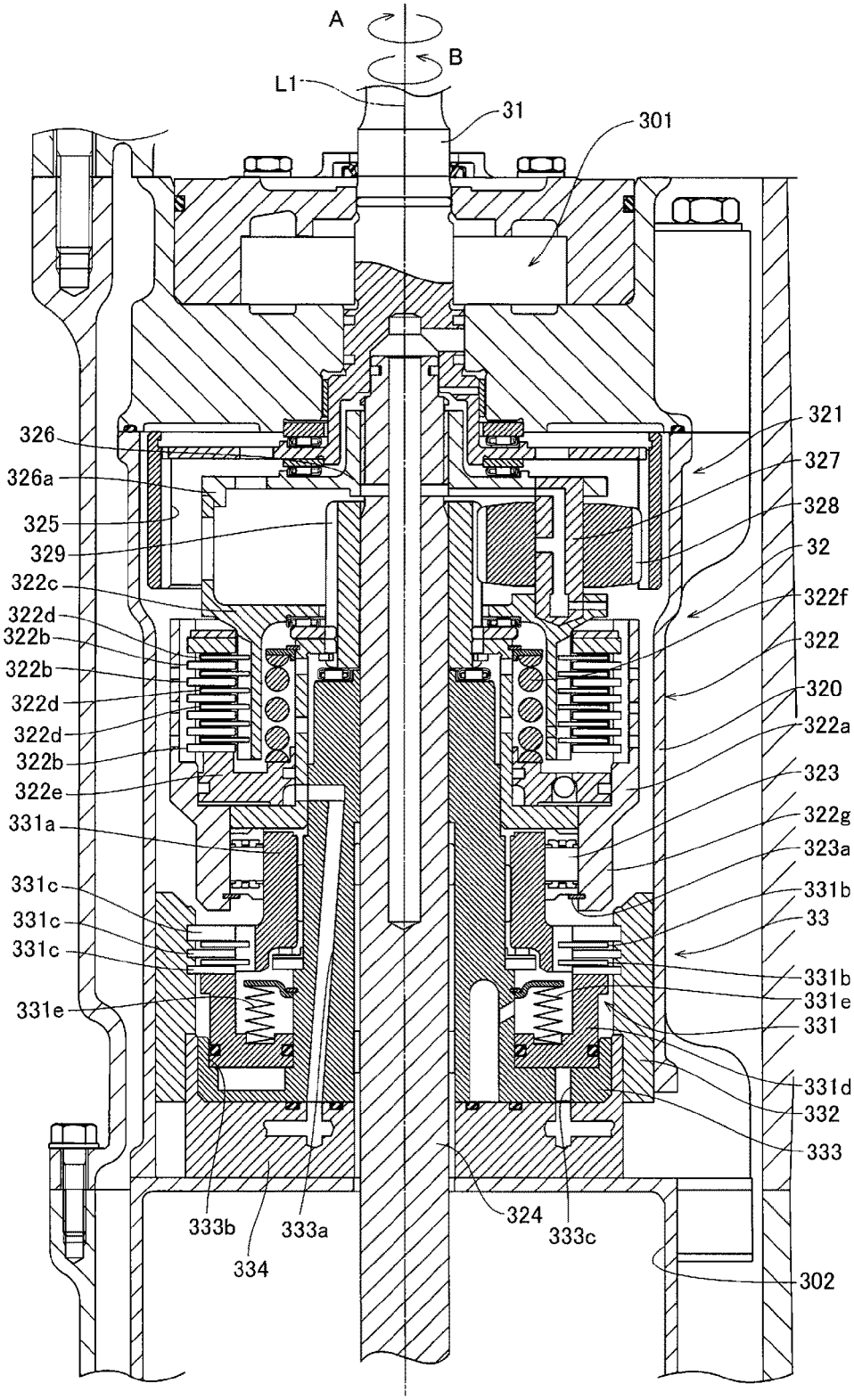
FIG. 4 is a cross-sectional view for explaining the construction of the transmission mechanism of the outboard motor according to the first preferred embodiment shown in FIG. 1.

A lower portion of the upper drive shaft 31 is connected to the transmission mechanism 32. As shown in FIG. 4, the transmission mechanism 32 is housed in a housing 320 and includes: a planetary gear set 321 that can reduce driving force of the upper drive shaft 31; a clutch 322 and a one way clutch 323 that control the rotation of the planetary gear set 321; and an intermediate shaft 324 to which driving force of the upper drive shaft 31 is transmitted via the planetary gear set 321. The transmission mechanism 32 is constructed in a manner such that the intermediate shaft 324 rotates at a rotational speed that is not reduced substantially with respect to the rotational speed of the upper transmission shaft 31 when the clutch 322 is engaged. On the other hand, the transmission mechanism 32 is constructed such that the rotational speed of the intermediate shaft 324 is reduced to be lower than the rotational speed of the upper drive shaft 31 by the rotation of the planetary gear set 321 when the clutch 322 is disengaged.

Figure 5:
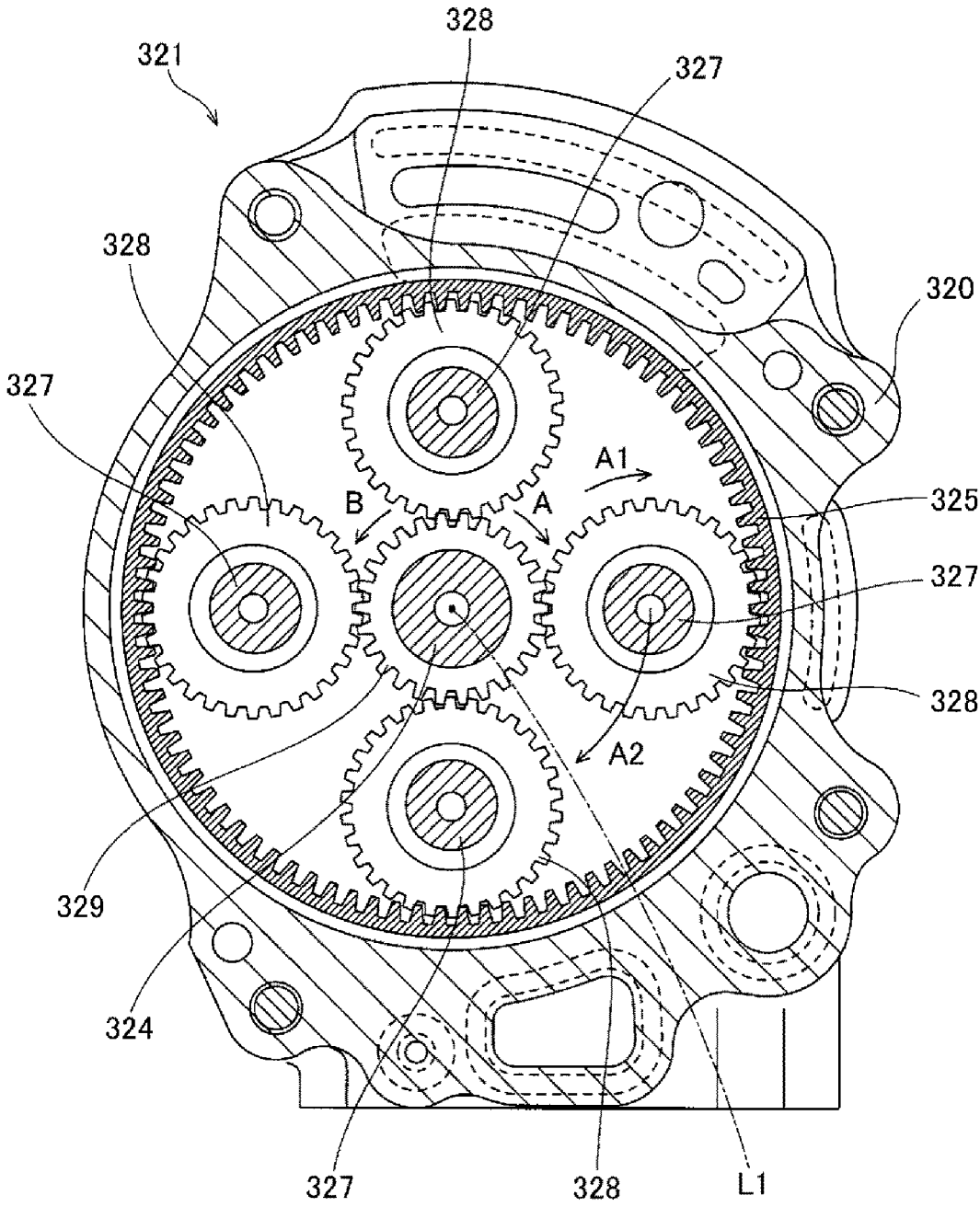
FIG. 5 is a cross-sectional view for explaining the construction of a planetary gear of the transmission mechanism of the outboard motor according to the first preferred embodiment shown in FIG. 1.

A ring gear 325 is disposed below the upper drive shaft 31. A flange member 326 is spline-fitted to an upper portion of the intermediate shaft 324. The flange member 326 is arranged inside the ring gear 325 (on the axis L1 side). As shown in FIG. 4 and FIG. 5, four shaft members 327 are fixed to a flange 326*a* of the flange member 326. Four planetary gears 328 are rotatably attached to the four shaft members 327. The four planetary gears 328 are meshed with the ring gear 325. The four planetary gears 328 are also each meshed with a sun gear 329 that is rotatable about the axis L1. As shown in FIG. 4, the sun gear 329 is attached to integrally rotate with an outer case 322*a* of the clutch 322.

The clutch 322 is preferably constructed with a wet-type multi-plate clutch. The clutch 322 preferably includes: the outer case 322*a* rotatable with the sun gear 329; a plurality of clutch plates 322*b* arranged in the outer case 322*a* with a certain gap therebetween; an inner case 322*c* at least partially arranged inside the outer case 322*a*; and a plurality of clutch plates 322*d* attached to the inner case 322*c* and each arranged between the plurality of clutch plates 322*b*. When the clutch plates 322*b* of the outer case 322*a* and the clutch plates 322*d* of the inner case 322*c* are in contact with each other, the clutch 322 becomes engaged, and the outer case 322*a* and the inner case 322*c* rotate integrally. On the other hand, when the clutch plate 322*b* of the outer case 322*a* and the clutch plates 322*d* of the inner case 322*c* are separated from each other, the clutch 322 becomes disengaged, and the outer case 322*a* and the inner case 322*c* do not rotate integrally.

Specifically, a piston 322*e* that is slidable on an inner surface of the outer case 322*a* is arranged in the outer case 322*a*. When the piston 322*e* is slid on the inner surface of the outer case 322*a*, the piston 322*e* moves the plurality of clutch plates 322*b* of the outer case 322*a* in the sliding direction of the piston 322*e*. A compression coil spring 322*f* is arranged in the outer case 322*a*. The compression coil spring 322*f* is arranged to urge the piston 322*e* in the direction in which the clutch plates 322*b* of the outer case 322*a* are separated from the clutch plates 322*d* of the inner case 322*c*. When pressure of oil that flows in an oil passage 333*a* of a lower inner edge holding portion 333, which is described later, increases based on a positional signal of the lever 5*a* transmitted by the control unit 51, the piston 322*e* slides on the inner surface of the outer case 322*a* against reaction force of the compression coil spring 322*f*. The increase and decrease of the pressure of oil that flows through the oil passage 333*a* in the lower inner edge holding portion 333 can cause the clutch plates 322*b* of the outer case 322*a* and the clutch plates 322*d* of the inner case 322*c* to contact with and separate from each other, which enables the clutch 322 to be engaged or disengaged.

The inner case 322*c* is integrally formed with the flange member 326, to which each top of the four shaft members 327 is attached, preferably by welding, for example. That is, the inner case 322*c* and the shaft member 327 rotate about the axis L1 at the same time in accordance with the rotation of the flange member 326.

A lower protrusion 322*g* that extends downward in the cylindrical shape is integrally formed in the outer case 322*a*. A one-way clutch 323 is preferably spline-fitted to an inner surface of the lower protrusion 322*g*. The one-way clutch 323 is supported upward by the ring member 323*a*. An outer surface of a connecting member 331*a* of a clutch 331 of the upper clutch mechanism 33, which is described later, is fitted to an inner surface of the one-way clutch 323. The one-way clutch 323 has a function to rotate its outer surface only in the A direction when the connecting member 331*a*, which is described later, is fixed to the housing 320 so as not to allow the rotation of the inner surface. In other words, the one-way clutch 323 is arranged to rotate the outer case 322*a* only in the A direction when the inner surface of the one-way clutch 323 is fixed so as not to be rotated. Accordingly, when the inner surface of the one-way clutch 323 is fixed so as not to be rotated, the sun gear 329, which is integrally rotated with the outer case 322*a*, can only be rotated in the A direction.

In the first preferred embodiment, the upper clutch mechanism 33 is arranged below the transmission mechanism 32. The upper clutch mechanism 33 is an example of the "first clutch mechanism" according to a preferred embodiment of the present invention. The upper clutch mechanism 33 preferably includes: a clutch 331 that can switch a rotational state of an inner periphery of the one-way clutch 323 so as for the inner periphery of the one-way clutch 323 to be fixed or idle with respect to the housing 320; an outer edge holding portion 332 that is disposed on a inner surface of the housing 320 and that holds the clutch plate 331*c* described later; a lower inner edge holding portion 333 that holds a lower portion and an inner periphery of the clutch 331; and a base portion 334 that fixes the outer edge holding portion 332 and the lower inner edge holding portion 333 and that constitutes a bottom portion of the housing 320. The clutch 331 is an example of the "plate clutch" according to a preferred embodiment of the present invention.

The clutch 331 is preferably constructed with a multi-plate wet clutch, and arranged on the axis L1 of the upper drive shaft 31. The clutch 331 is constructed to be switchable between an engaged state (first engagement state) in which driving force of the engine 30 is transmitted to a front propeller drive shaft 363 and a rear propeller drive shaft 364, and an disengaged state (first disengagement state) in which driving force of the engine 30 to be transmitted is disengaged. Also, the clutch 331 is constructed to be switchable to a half-clutch state (half-engaged state) in which a portion of the driving force of the engine 30 is transmitted to the front propeller drive shaft 363 and the rear propeller drive shaft 364. The clutch 331 of the upper clutch mechanism 33 in accordance with the first preferred embodiment preferably includes: the connecting member 331*a*, the top of which is fitted to an inner surface of the one-way clutch 323; the two clutch plates 331*b* and 331*c* attached to the bottom of the connecting member 331*a*; the clutch plate 331*c* arranged to sandwich the clutch plate 331*b* and held by the outer edge holding portion 332; and a piston 331*d* that is arranged in the cylinder portion 333*b* of the lower inner edge holding portion 333, and that moves the clutch plate 331*c* and the clutch plate 331*b*. The clutch plate 331*b* and the clutch plate 331*c* are examples of the "plate member" according to a preferred embodiment of the present invention.

The clutch 331 is fixed so that the connecting member 331*a* does not rotate with respect to the outer edge holding portion 332 when the clutch plate 331*b* that is attached to the connecting member 331*a* comes into contact with (is connected to) the clutch plate 331*c* that is held by the outer edge holding portion 332. In this case, the one-way clutch 323 can be fixed to the outer edge holding portion 332 while the inner surface of the one-way clutch 323 is prevented from rotating. Accordingly, because an outer surface of the one-way clutch 323 can only be rotated in the A direction, the outer case 322*a* can also be rotated in the A direction only. As a result, when an inner surface of the one-way clutch 323 is fixed so as not to be rotated, the sun gear 329, which is integrally rotated with the outer case 322*a*, can be rotated only in the A direction.

On the other hand, in the clutch 331, the connecting member 331*a* is idled with respect to the outer edge holding portion 332 when the clutch plate 331*b* that is attached to the connecting member 331*a* separates from the clutch plate 331*c* that is held by the outer edge holding portion 332. In this case, an inner surface of the one-way clutch 323 is idled with respect to the outer edge holding portion 332. Thus, the outer surface of the one-way clutch 323 is rotated not only in the A direction but also in the B direction. As a result, when an inner surface of the one-way clutch 323 is idled with respect to the outer edge holding portion 332, the sun gear 329, which is integrally rotated with the outer case 322*a*, is rotated not only in the A direction but also in the B direction. At this time, because the sun gear 329 is also idled when the planetary gears 328, which are meshed with the sun gear 329, are rotated, driving force of the engine 30 is not transmitted to the flange member 326 and the shaft member 327.

A plurality of compression coil springs 331*e* are attached to the lower inner edge holding portion 333. The plurality of compression coil springs 331*e* are arranged to urge the piston 331*d* to the cylinder portion 333*b* of the lower inner edge holding portion 333. An oil passage 333*c* is formed at the bottom of the cylinder portion 333*b* of the lower inner edge holding portion 333. The piston 331*d* is constructed to move upward against reaction force of the compression coil spring 331*e* when pressure of oil, which flows in the oil passage 333*c* of the lower inner edge holding portion 333, increases based on a positional signal of the lever 5*a* that is transmitted by the control unit 51.

According to the constructions of the transmission mechanism 32 and the upper clutch mechanism 33 as described above, when the clutch 331 of the upper clutch mechanism 33 is engaged, and when the clutch 322 of the transmission mechanism 32 is disengaged, the ring gear 325 is rotated in the A direction in accordance with the rotation of the upper drive shaft 31 in the A direction. In this case, the sun gear 329 does not rotate in the B direction, which is opposite to the A direction, because of the one-way clutch 323 in which an inner surface is fixed with respect to the outer edge holding part 332. Therefore, as shown in FIG. 5, each of the planetary gears 328 rotates about the shaft member 327 in the A1 direction and at the same time revolves around the axis L1 in the A2 direction with the shaft member 327. This allows the flange member 326 (see FIG. 4) to rotate in the A direction about the axis L1 as the shaft members 327 move in the A2 direction. As a result, as shown in FIG. 4, the intermediate shaft 324 that is spline-fitted to the flange member 326 can be rotated about the axis L1 in the A direction at the rotational speed that is lower than the upper drive shaft 31.

According to the constructions of the transmission mechanism 32 and the upper clutch mechanism 33 as described above, when the clutch 331 of the upper clutch mechanism 33 is engaged, and when the clutch 322 of the transmission mechanism 32 is engaged, the ring gear 325 is rotated in the A direction in accordance with the rotation of the upper drive shaft 31 in the A direction. At this time, as shown in FIG. 4, because the clutch 322 is engaged, the outer case 322*a* of the clutch 322 is rotated in the A direction together with the one-way clutch 323. Consequently, the sun gear 329 is rotated in the A direction about the axis L1, and thus the shaft members 327 move in the A direction about the axis L1 while the planetary gears 328 are not substantially rotated about the shaft members 327. Accordingly, the flange member 326 rotates at a speed generally equivalent to the rotational speed of the upper drive shaft 31 while the speed is not substantially reduced by the planetary gears 328. As a result, the intermediate shaft 324 can be rotated about the axis L1 in the A direction at the speed generally equivalent to the rotational speed of the upper drive shaft 31.

When the clutch 331 of the upper clutch mechanism 33 is disengaged, and when the clutch 322 of the transmission mechanism 32 is disengaged, the sun gear 329 is idled. Therefore, driving force of the engine 30 is not transmitted to the flange member 326 and the shaft member 327.

An oil pan 302 is disposed below the upper clutch mechanism 33. Oil, which is supplied to the transmission mechanism 32 and so forth by the oil pump 301, is reserved in the oil pan 302. As shown in FIG. 2, a water pump 303, which is driven when the driving force of the engine 30 is transmitted to the lower drive shaft 34 by the upper clutch mechanism 33, is disposed below the oil pan 302 (downstream side of the upper clutch mechanism 33). The water pump 303 has a function to pump up water (cooling water) from water surface and to send the pumped-up water to the oil pan 302 and the engine 30.

Now, construction of the lower mechanism 36 that is disposed below the water pump 303 is described.

Figure 6:
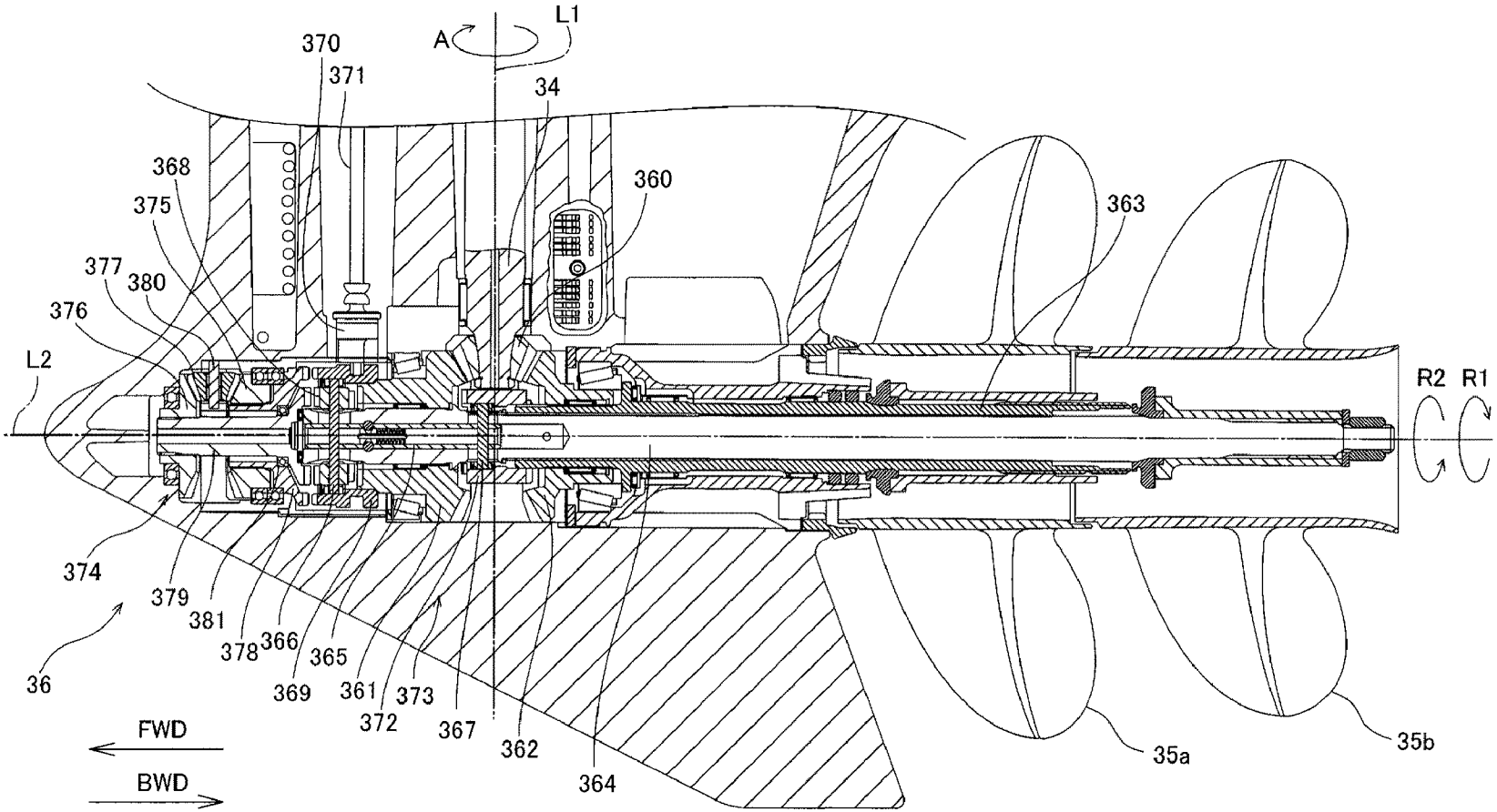
FIG. 6 is a cross-sectional view for explaining the construction of a lower mechanism of the outboard motor according to the first preferred embodiment shown in FIG. 1.
Figure 7:
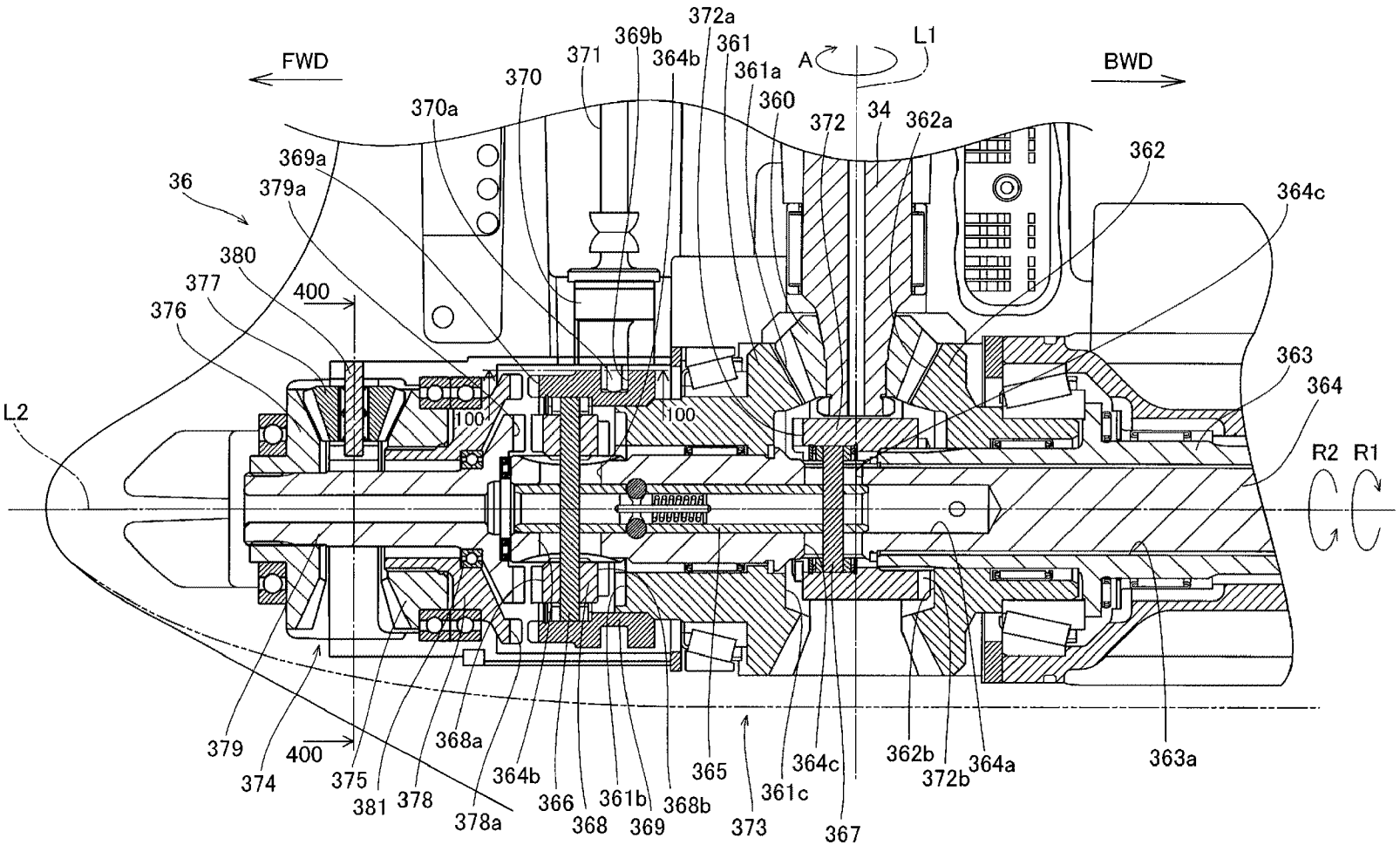
FIG. 7 is a cross-sectional view for explaining the construction of the lower mechanism of the outboard motor according to the first preferred embodiment shown in FIG. 1.

As shown in FIG. 6 and FIG. 7, a lower portion of the lower drive shaft 34 is arranged in the lower mechanism 36. A bevel gear 360 is attached to the vicinity of a lower end portion (the bottom) of the lower drive shaft 34. The bevel gear 360 is an example of the "speed reduction portion" according to a preferred embodiment of the present invention. The bevel gear 360 is meshed with a gear 361*a* of a front bevel gear 361 that is arranged below the arrow FWD, and also meshed with a gear 362*a* of a rear bevel gear 362 arranged below the arrow BWD. The front bevel gear 361 and the rear bevel gear 362 are examples of the "speed reduction portion" according to a preferred embodiment of the present invention. An axis L2 around which the front bevel gear 361 and the rear bevel gear 362 rotate is perpendicular or substantially perpendicular to the axis L1 around which the bevel gear 360 rotates, and extends in the arrow FWD direction. The bevel gear 360, the front bevel gear 361, and the rear bevel gear 362 can transmit the rotation of the lower drive shaft 34 at the reduced speed to the front propeller drive shaft 363 and the rear propeller drive shaft 364.

As shown in FIG. 7, a dog 361*b*, which can engage with and separate from a dog clutch 368 described later, is disposed in an end portion of the front bevel gear 361 in the arrow FWD direction. A dog clutch 369 described later is engaged with an outer edge of the front bevel gear 361 in the arrow FWD direction in a way that the dog clutch 369 can slide in the fore-and-aft direction. The dog 361*b* is an example of the "engagement portion" according to a preferred embodiment of the present invention. A dog 361*c*, which can engage with and separate from a dog clutch 372 described later, is disposed in a portion on the arrow BWD side of the front bevel gear 361 and on the axis L2 side of the gear 361*a*. The dog 361*c* is an example of the "engagement portion" according to a preferred embodiment of the present invention. A dog 362*b*, which can engage with or separate from a dog clutch 372 described later, is disposed in a portion on the arrow FWD side of the rear bevel gear 362 and on the axis L2 side of the gear 362*a*. The dog 362*b* is an example of the "engagement portion" according to a preferred embodiment of the present invention.

The front propeller drive shaft 363 and the rear propeller drive shaft 364, which extend in the direction perpendicular or substantially perpendicular to the lower drive shaft 34, are disposed below the lower drive shaft 34. The front propeller drive shaft 363 is an example of the "output shaft" and the "first output shaft" according to a preferred embodiment of the present invention, and the rear propeller drive shaft 364 is an example of the "output shaft" and the "second output shaft" according to a preferred embodiment of the present invention. The front propeller drive shaft 363 and the rear propeller drive shaft 364 are constructed to be rotatable in a different direction from each other. The front propeller drive shaft 363 is arranged to rotate about the axis L2, and preferably has a hollow (cylindrical) shape along the axis L2. As shown in FIG. 6, on the arrow BWD side of the front propeller drive shaft 363, the front propeller 35*a* is attached so as to be rotatable with the front propeller drive shaft 363. On the arrow FWD side of the front propeller drive shaft 363, the rear bevel gear 362 is arranged so as to idle with respect to the front propeller drive shaft 363. As shown in FIG. 7, on the periphery of the arrow FWD side where the rear bevel gear 362 of the front propeller drive shaft 363 is arranged, the dog clutch 372 is engaged to be slidable in the fore-and-aft direction.

The rear side propeller drive shaft 364 is inserted in a hollow portion 363*a* along the axis L2 of the front propeller drive shaft 363. In the same way as the front propeller drive shaft 363, the rear propeller drive shaft 364 is arranged to rotate about the axis L2. As shown in FIG. 6, the rear propeller drive shaft 364 is longer than the front propeller drive shaft 363 in the fore-and-aft direction. An end portion of the rear propeller drive shaft 364 in the arrow FWD direction is arranged to protrude from an end portion of the front propeller drive shaft 363 in the arrow FWD direction. Also, an end portion of the rear propeller drive shaft 364 in the arrow BWD direction is arranged to protrude from an end portion of the front propeller drive shaft 363 in the arrow BWD direction. On the arrow BWD side of the rear propeller drive shaft 364, the rear propeller 35*b* described above is attached to be rotatable with the rear propeller drive shaft 364. On the arrow FWD side of the rear propeller drive shaft 364, the front bevel gear 361 is arranged so as to idle with respect to the rear propeller drive shaft 364. As shown in FIG. 7, on the periphery of the rear propeller drive shaft 364 in the arrow FWD side of a portion where the front bevel gear 361 is arranged, the dog clutch 368, which is described later, is spline-fitted to be slidable in the fore-and-aft direction.

An insertion hole 364*a* is formed along the axis L2 on the arrow FWD side of the rear propeller drive shaft 364. A through hole 364*b* that is perpendicular or substantially perpendicular to the insertion hole 364*a* is formed in an outer surface near an end portion of the rear propeller drive shaft 364 on the arrow FWD side. Also, a through hole 364*c* that is orthogonal to the insertion hole 364*a* is formed in an outer surface near an end portion of the front propeller drive shaft 363 of the rear propeller drive shaft 364 on the arrow FWD side. The through holes 364*b* and 364*c* are each formed in the shape of a slot that extends in the fore-and-aft direction (in the arrow FWD direction and the arrow BWD direction).

In the insertion hole 364*a* along the axis L2 of the rear propeller drive shaft 364, a connecting member 365 in a cylindrical shape is inserted so as to be slidable in the fore-and-aft direction (in the arrow FWD direction and the arrow BWD direction). To a portion corresponding to the through hole 364*b* of the connecting member 365, the rod-shaped connecting member 366 is attached to be perpendicular or substantially perpendicular to the connecting member 365. The connecting member 366 is arranged so as to protrude outside from an outer surface of the rear propeller drive shaft 364. The connecting member 366 is slid along the through hole 364*b* in the fore-and-aft direction when the connecting member 365 is slid along the insertion hole 364*a*. To a portion corresponding to the through hole 364*c* of the connecting member 365, the rod-shaped connecting member 367 is attached to be perpendicular or substantially perpendicular to the connecting member 365. The connecting member 367 is arranged to protrude outside from an outer surface of the rear propeller drive shaft 364. The connecting member 367 is slid on the through hole 364*c* in the fore-and-aft direction when the connecting member 365 is slid along the insertion hole 364*a*.

Figure 8:
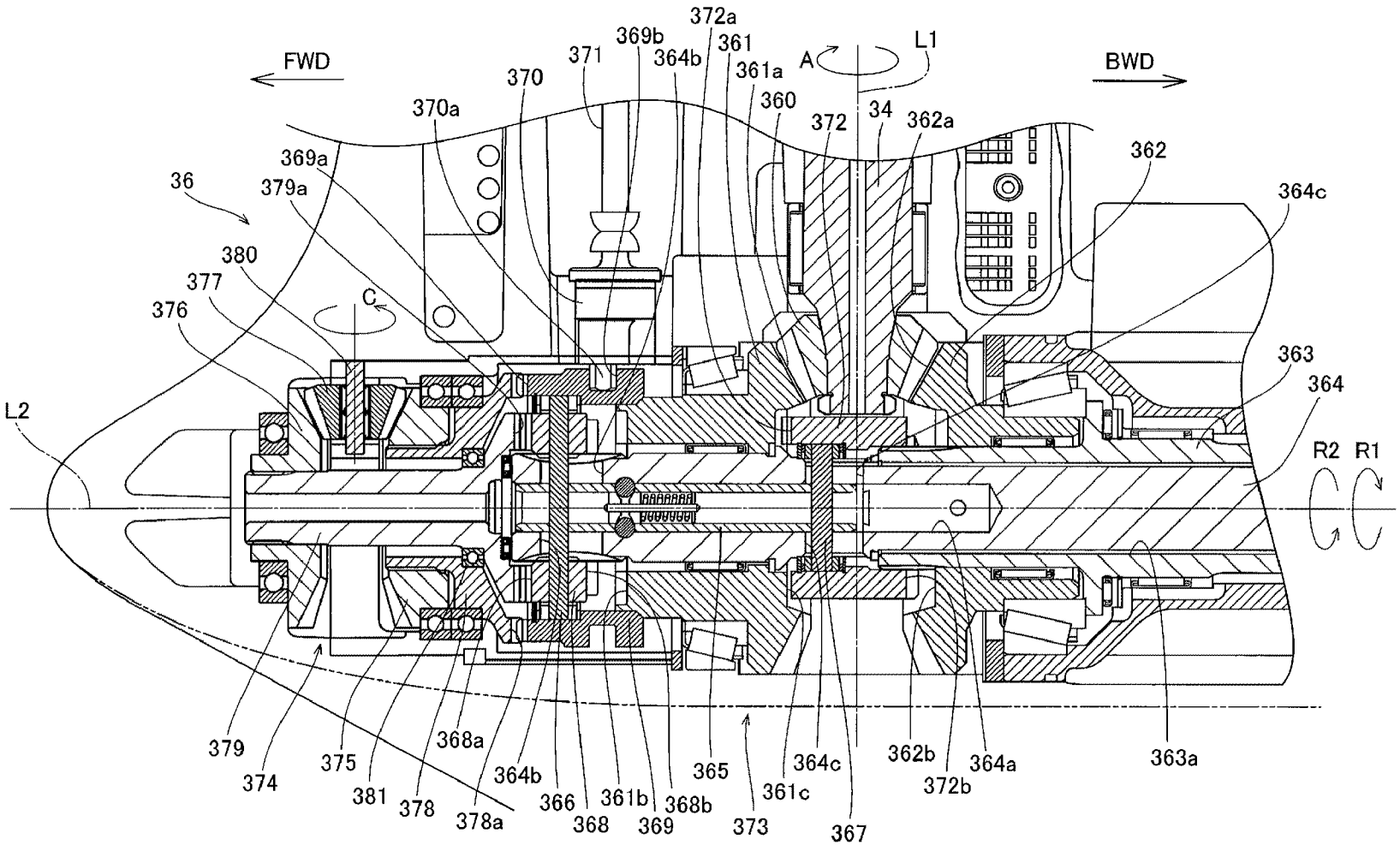
FIG. 8 is a cross-sectional view for explaining the construction of the lower mechanism of the outboard motor according to the first preferred embodiment shown in FIG. 1.
Figure 9:
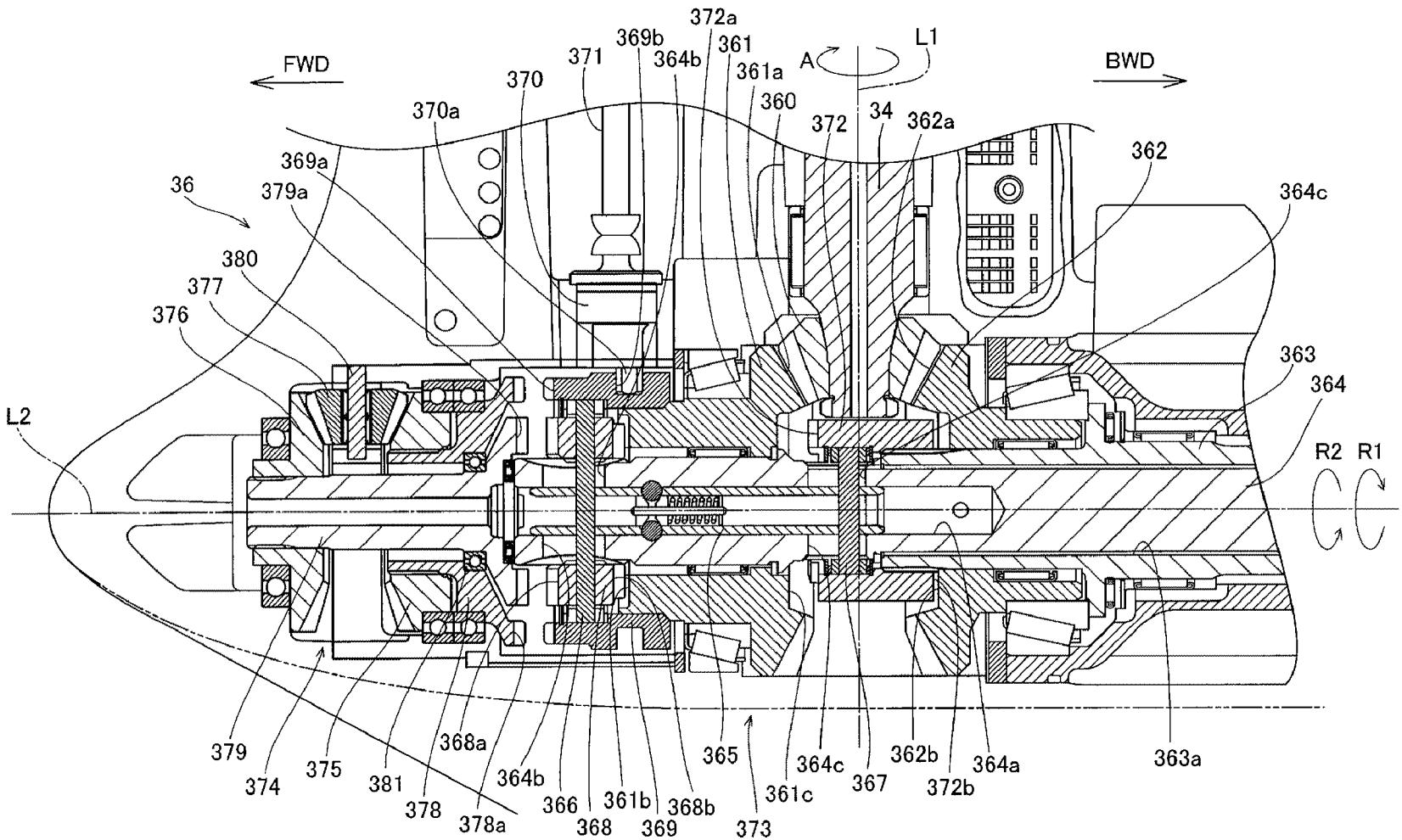
FIG. 9 is a cross-sectional view for explaining the construction of the lower mechanism of the outboard motor according to the first preferred embodiment shown in FIG. 1.

The dog clutch 368 and the dog clutch 369 are fixed to the connecting member 366. The dog clutch 368 is attached to an outer surface of the rear propeller drive shaft 364 preferably by spline-fitting, so that the dog clutch 368 can slide with respect to the rear propeller drive shaft 364 as described above, and can also rotate together with the rear propeller drive shaft 364. That is, the dog clutch 368 is constructed to rotate with the rear propeller drive shaft 364 at all times. A front dog 368*a* is disposed in the dog clutch 368 on the arrow FWD side. Also, a rear dog 368*b* is disposed in the dog clutch 368 on the arrow BWD side. The front dog 368*a* and the rear dog 368*b* are examples of the "engagement portion" according to a preferred embodiment of the present invention. As shown in FIG. 8, when the dog clutch 368 is slid in the arrow FWD direction, the front dog 368*a* is engaged with a dog 379*a* of the output shaft 379 described later. On the other hand, as shown in FIG. 9, when the dog clutch 368 is slid in the arrow BWD direction, the rear dog 368*b* is engaged with the dog 361*b* of the front bevel gear 361. That is, as shown in FIG. 8, when the dog clutch 368 is engaged with the output shaft 379 of the reverse drive 374 described later, the rotation of the output shaft 379 of the reverse drive 374 is transmitted to the reverse propeller drive shaft 364. On the other hand, as shown in FIG. 9, when the dog clutch 368 is engaged with the front bevel gear 361, the rotation of the front bevel gear 361 is directly transmitted to the rear propeller drive shaft 364. As shown in FIG. 7, when the dog clutch 368 is in a neutral position, where the dog clutch 368 is not engaged either with the front bevel gear 361 or with the output shaft 379 described later, driving force of the bevel gear 360 (engine 30) is not transmitted to the front propeller drive shaft 363 and the rear propeller drive shaft 364.

The dog clutch 369 is arranged to cover an outer surface of the dog clutch 368 and slid in the fore-and-aft direction with the dog clutch 368. As described above, the dog clutch 369 is attached to an outer surface of the front bevel gear 361 preferably by spline-fitting, so that the dog clutch 369 can slide with respect to the front bevel gear 361 and can rotate with the front bevel gear 361. That is, the dog clutch 369 is constructed to rotate together with the front bevel gear 361 at all times. A dog 369*a* is disposed in the dog clutch 369 on the arrow FWD side. The dog 369*a* is an example of the "engagement portion" according to a preferred embodiment of the present invention. As shown in FIG. 8, when the dog clutch 369 is slid in the arrow FWD direction, the dog 369*a* is engaged with a dog 378*a* of the input shaft 378 described later. On the other hand, as shown in FIG. 9, when the dog clutch 369 is slid in the arrow BWD direction, the dog 369*a* is separated from a dog 378*a* of the input shaft 378. That is, as shown in FIG. 8, when the dog clutch 368 is engaged with the input shaft 378 of the reverse drive 374 described later, the rotation of the front bevel gear 361 is transmitted to the input shaft 378 of the reverse drive 374.

Figure 10:
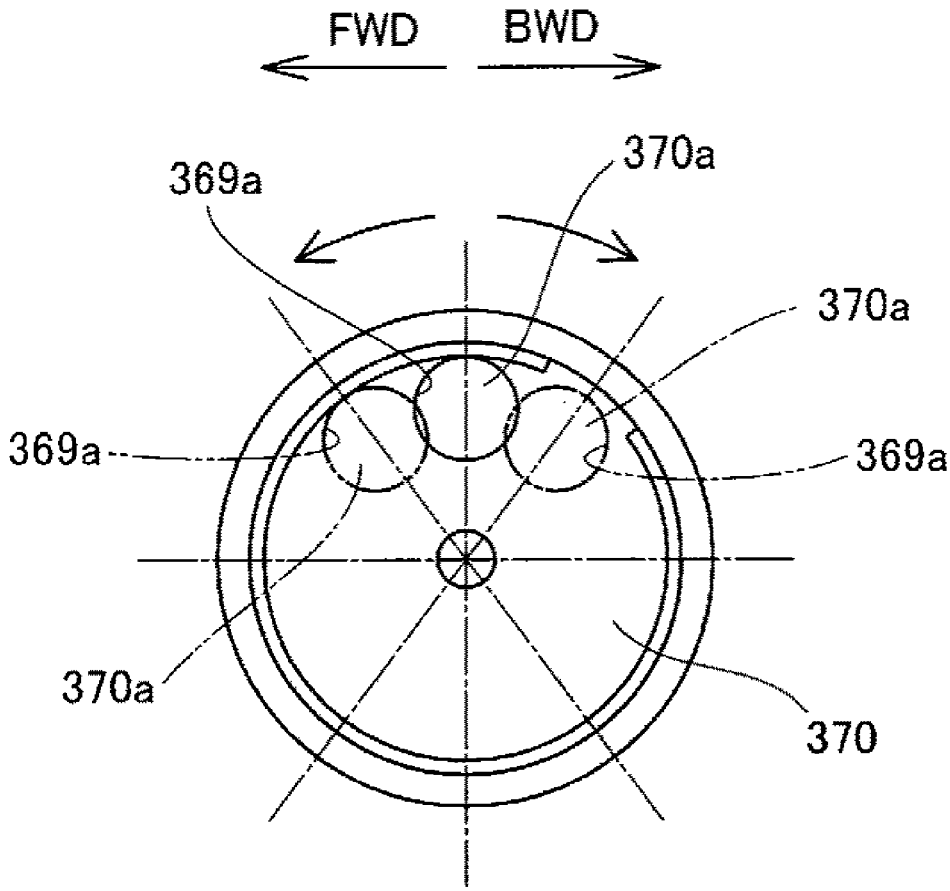
FIG. 10 is a cross-sectional view taken along the line in FIG. 7.

As shown in FIG. 7, a groove 369*b* is formed on the entire outer surface of the dog clutch 369. As shown in FIG. 7 and FIG. 10, a convex part 370*a* of an advance-reverse switching lever 370 is engaged with the groove 369*b*, and the dog clutch 369 can move in the fore-and-aft direction when the convex part 370*a* is moved in the fore-and-aft direction in accordance with the rotation of the advance-reverse switching lever 370. In the first preferred embodiment, as shown in FIG. 2, the advance-reverse switching lever 370 is connected to an actuator (not shown) that is arranged in the case 300 via a linkage 371. The advance-reverse switching lever 370 is rotated by drive of the actuator (not shown) based on a positional signal of the lever 5*a* that is transmitted by the control unit 51 (refer to FIG. 3).

The dog clutch 372 is fixed to the connecting member 367. The dog clutch 372 is attached to an outer surface of the front propeller drive shaft 363 preferably by spline-fitting, so that the dog clutch 372 can slide with respect to the front propeller drive shaft 363 as described above and can rotate together with the front propeller drive shaft 363. That is, the dog clutch 372 is constructed to rotate together with the front propeller drive shaft 363 at all times. A front dog 372*a* is disposed in the dog clutch 372 on the arrow FWD side. Also, a rear dog 372*b* is disposed in the dog clutch 372 on the arrow BWD side. The front dog 372*a* and the rear dog 372*b* are examples of the "engagement portion" according to a preferred embodiment of the present invention. As shown in FIG. 8, when the dog clutch 372 is slid in the arrow FWD direction, the front dog 372*a* is engaged with a dog 361*c* of the front bevel gear 361. On the other hand, as shown in FIG. 9, when the dog clutch 372 is slid in the arrow BWD direction, the rear dog 372*b* is engaged with the dog 362*b* of the rear bevel gear 362. That is, as shown in FIG. 8, when the dog clutch 372 is engaged with the front bevel gear 361, rotation of the front bevel gear 361 is directly transmitted to the front propeller drive shaft 363. On the other hand, as shown in FIG. 9, when the dog clutch 372 is engaged with the rear bevel gear 362, the rotation of the rear bevel gear 362 is directly transmitted to the front propeller drive shaft 363. As shown in FIG. 7, when the dog clutch 372 is in a neutral position where the dog clutch 372 is not engaged either with the front bevel gear 361 or with the rear bevel gear 362, driving force of the bevel gear 360 is not transmitted to the front propeller drive shaft 363 and the rear propeller drive shaft 364.

The dog clutch 372 is slid in the fore-and-aft direction together with the dog clutches 368 and 369 via the connecting members 367, 365, and 366. That is, the dog clutch 372 can move in the fore-and-aft direction in accordance with the rotation of the advance-reverse switching lever 370 in the same way as the dog clutches 368 and 369. In the first preferred embodiment, the advance-reverse drive 373 is constituted by the connecting members 365, 366, and 367, and the dog clutches 368, 369, and 372. The advance-reverse drive 373 is arranged on the axis L2 and driven during the forward travel and reverse travel of the boat 1.

Figure 12:
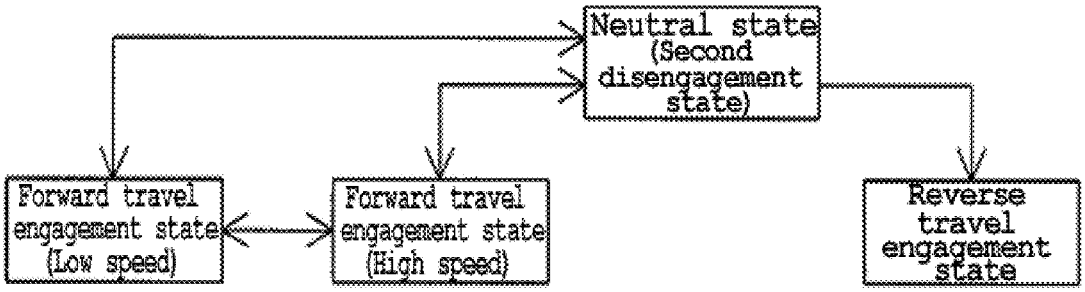
FIG. 12 is a view for explaining the construction of the transmission mechanism and the advance-reverse drive of the outboard motor according to the first preferred embodiment shown in FIG. 1.

In the first preferred embodiment, the advance-reverse drive 373 is shifted into a reverse travel engagement state (second engagement state) in which the driving force of the engine 30 can be transmitted to the front propeller 35*a* and the rear propeller 35*b* to reverse (propel) the boat 1 when the dog clutches 368, 369, and 372 are moved in the arrow FWD direction. On the other hand, the advance-reverse drive 373 is shifted into a forward travel engagement state (second engagement state) in which the driving force of the engine 30 can be transmitted to the front propeller 35*a* and the rear propeller 35*b* to advance (propel) the boat 1 when the dog clutches 368, 369, and 372 are moved in the arrow BWD direction. The advance-reverse drive 373 is shifted into a disengagement state (2nd disengagement state) in which the driving force of the engine 30 is disengaged when the dog clutches 368, 369, and 372 are moved to the neutral position where none of the dog clutches is engaged with any of the dogs. That is, as shown in FIG. 12, the advance-reverse drive 373 in the first preferred embodiment can switch an engagement state between the forward engagement state and the reverse travel engagement state only through a neutral state (second disengagement state).

The dog clutches 368, 369, and 372 of the advance-reverse drive 373 can switch an engagement state to either the forward travel engagement state (second engagement state) or the reverse travel engagement state (second engagement state) when the upper clutch mechanism 33 is in a half clutch state (half-engaged state). Specifically, when a user turns the lever 5*a* from a neutral state to the arrow FWD direction or the arrow BWD direction, the control unit 51 controls the upper clutch mechanism 33 to be in the half clutch state (half-engaged state), and also controls the dog clutches 368, 369, and 372 to move in the arrow BWD direction or the arrow FWD direction. When a disengagement state (first disengagement state) in which the clutch 331 of the upper clutch mechanism 33 disengages the driving force of the engine 30, and a disengagement state (second disengagement state) in which the dog clutches 368, 369, and 372 of the advance-reverse drive 373 disengages the driving force of the engine 30 are maintained for a certain period t (approximately 1 second), the control unit 51 performs control to switch the engagement state of the clutch 331 of the upper clutch mechanism 33 into an engagement state (first engagement state) after the elapse of the certain period t.

In the first preferred embodiment, the reverse drive 374, which is driven during the reverse travel of the boat 1, is disposed in the advance-reverse drive 373 on the axis L2 in the arrow FWD side. The advance-reverse drive 373 and the reverse drive 374 are examples of the "second clutch mechanism" according to a preferred embodiment of the present invention. The reverse drive 374 preferably includes: a bevel gear 375 and a bevel gear 376 that can rotate about the axis L2; three bevel gears 377 that are arranged between the bevel gear 375 and the bevel gear 376; the input shaft 378 that is attached to the bevel gear 375 and constructed to be able to connect with the dog clutch 369; the output shaft 379 that is attached to the bevel gear 376 and constructed to be able to connect with the dog clutch 368.

The bevel gear 375 is spline-fitted to an outer surface of the input shaft 378 in the arrow FWD side and is constructed to be rotatable with the input shaft 378. The input shaft 378 preferably has a hollow shape along the axis L2. The arrow FWD side of the input shaft 378 preferably has a cylindrical shape. The arrow BWD side of the input shaft 378 is larger in diameter than the arrow FWD side thereof. The dog 378*a* is disposed on the input shaft 378 in the arrow BWD side. The dog 378*a* can be engaged with or separate from the dog 369*a* of the dog clutch 369. In other words, as shown in FIG. 8, the bevel gear 375 is rotated in the same direction (R1 direction) as the front bevel gear 361, when the input shaft 378 is engaged with the dog clutch 369.

Figure 11:
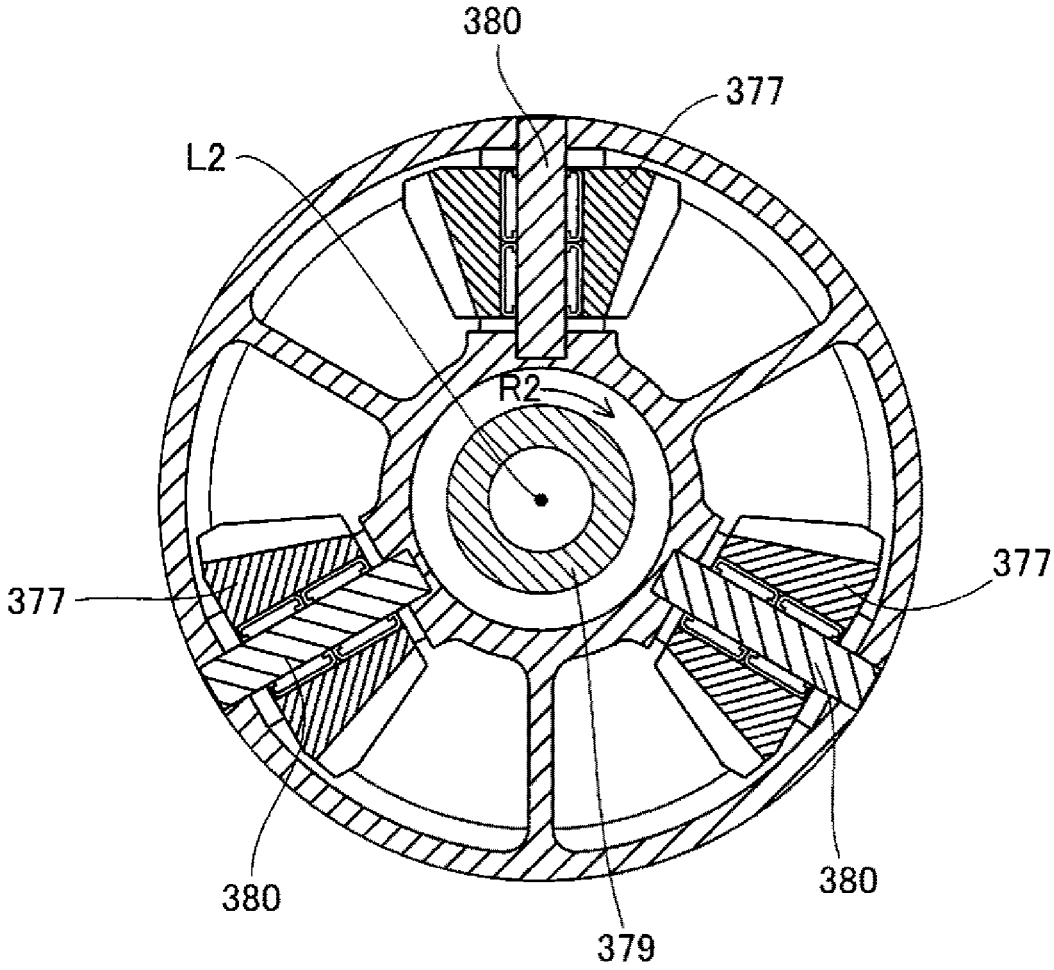
FIG. 11 is a cross-sectional view taken along the line in FIG. 7.

In the first preferred embodiment, as shown in FIG. 7 and FIG. 11, the three bevel gears 377 are meshed with the bevel gear 375. As shown in FIG. 11, the three bevel gears 377 are rotatably supported by the rotational shaft 380, which extends in a direction that is perpendicular or substantially perpendicular to the bevel gear 375. As shown in FIG. 7, the three bevel gears 377 are meshed with the bevel gear 376. According to this arrangement of the bevel gears 375, 376, and 377, it is possible to reverse the rotational direction of the bevel gear 376 (R2 direction) with respect to the rotational direction of the bevel gear 375 (R1 direction). The bevel gear 376 is preferably spline-fitted to an outer surface of the output shaft 379 in the arrow FWD side and is constructed to be rotatable with the output shaft 379. The output shaft 379 preferably has a cylindrical shape, and a portion thereof in the BWD side is inserted in an opening of the input shaft 378 via a bearing 381 so as to be rotatable with respect to the input shaft 378. A dog 379*a* is disposed in the output shaft 379 on the arrow BWD side. The dog 379*a* is arranged on the outside of an outer surface of the rear propeller 364 and is constructed to be able to engage with or disengage from the front dog 368*a* of the dog clutch 368, which is positioned on the outside of an outside surface of the rear propeller drive shaft 364.

Now, a driving force transmission path in the lower mechanism 36 is described in detail. First, description is made of the driving force transmission path upon the reverse travel when the advance-reverse drive 373 (dog clutches 368, 369, 372) is shifted in the arrow FWD direction.

As shown in FIG. 2, the crankshaft 30*a* is rotated in the A direction by the drive of the engine 30. The driving force of the engine 30 is transmitted to the lower drive shaft 34 via the transmission mechanism 32 and the upper clutch mechanism 33, and then the lower drive shaft 34 is rotated in the A direction. As shown in FIG. 7, the rotation of the lower drive shaft 34 in the A direction is input to the lower mechanism 36.

Along with the rotation of the lower drive shaft 34 in the A direction, the bevel gear 360 that is attached to the vicinity of the lower end portion of the lower drive shaft 34 is rotated in the A direction. Along with the rotation of the bevel gear 360 in the A direction, the front bevel gear 361 is rotated in the R1 direction, and the rear bevel gear 362 is rotated in the R2 direction. The R1 direction is an example of the "second direction" according to a preferred embodiment of the present invention, and the R2 direction is an example of the "first direction" according to a preferred embodiment of the present invention.

Now, description is made of a driving force transmission path, which transmits the driving force of the lower drive shaft 34 (engine 30) to the front propeller drive shaft 363 in the case that the advance-reverse drive 373 (dog clutches 368, 369, 372) is shifted in the arrow FWD direction. As shown in FIG. 8, because the advance-reverse drive 373 (dog clutches 368, 369, 372) is shifted in the arrow FWD direction, the front dog 372*a* of the dog clutch 372 is engaged with the dog 361*c* of the front bevel gear 361. Accordingly, the rotation of the front bevel gear 361 in the R1 direction is transmitted to the dog clutch 372, and the dog clutch 372 is rotated in the R1 direction. Because the dog clutch 372 is attached to the front propeller drive shaft 363, the front propeller shaft 363 is rotated in the R1 direction. As a result, the front propeller 35*a* is rotated in the R1 direction as shown in FIG. 6. At this time, as shown in FIG. 8, the rear dog 372*b* of the dog clutch 372 is not engaged with the dog 362*b* of the rear bevel gear 362. Thus, the rear bevel gear 362 idles with respect to the front propeller drive shaft 363. That is, the rotation of the rear bevel gear 362 in the R2 direction is not transmitted to either the front propeller drive shaft 363 or the rear propeller drive shaft 364.

Now, while referring to FIG. 6 and FIG. 8, description is made of a driving force transmission path, which transmits the driving force of the lower drive shaft 34 (engine 30) to the rear propeller drive shaft 364 in the case that the advance-reverse drive 373 (dog clutches 368, 369, 372) is shifted in the arrow FWD direction. As shown in FIG. 8, because the advance-reverse drive 373 (dog clutches 368, 369, 372) is shifted in the arrow FWD direction, the front dog 368*a* of the dog clutch 368 is engaged with the dog 379*a* of the output shaft 379, and the dog 369*a* of the dog clutch 369 is engaged with the dog 378*a* of the input shaft 378.

As described above, because the front bevel gear 361 is rotated in the R1 direction, the dog clutch 369 is rotated in the R1 direction in the same way as the front bevel gear 361. Accordingly, the input shaft 378 is rotated in the R1 direction via the dog clutch 369. Because the bevel gear 375 is attached to the input shaft 378, the bevel gear 375 is rotated about the axis L2 in the R1 direction.

The rotation of the bevel gear 375 in the R1 direction is transmitted to the three bevel gears 377, which are meshed with the bevel gear 375. The three bevel gears 377 are rotated about the rotational shaft 380 in the C direction in accordance with the rotation of the bevel gear 375 in the R1 direction. The rotation of the three bevel gears 377 in the C direction is transmitted to the bevel gear 376. The bevel gear 376 is rotated about the axis L2 in the R2 direction in accordance with the rotation of the three bevel gears 377 in the B direction. That is, by the bevel gears 375, 376, and 377, the rotation of the bevel gear 375 in the R1 direction is changed to the rotation in the R2 direction in the bevel gear 376. The rotation of the bevel gear in the R2 direction is transmitted to the output shaft 379, and the output shaft 379 is rotated about the axis L2 in the R2 direction.

Because the dog 379*a* of the output shaft 379 and the front dog 368*a* of the dog clutch 368 are engaged, the rotation of the output shaft 379 in the R2 direction is transmitted to the dog clutch 368. The dog clutch 368 is rotated in the R2 direction. The rear propeller drive shaft 364, to which the dog clutch 368 is attached, is rotated in the R2 direction. As a result, the rear propeller 35*b* is rotated in the R2 direction as shown in FIG. 6.

As described above, when the advance-reverse drive 373 (dog clutches 368, 369, 372) is shifted in the arrow FWD direction, the front propeller 35*a* is rotated in the R1 direction, and the rear propeller 35*b* is rotated in the R2 direction. As a result, the boat 1 is propelled (reversed) in the arrow BWD direction.

Now, while referring to FIG. 6 and FIG. 9, description is made of a driving force transmission path, which transmits the driving force of the lower drive shaft 34 (engine 30) to the front propeller drive shaft 363 in the case that the advance-reverse drive 373 (dog clutches 368, 369, 372) is shifted in the arrow BWD direction when the boat 1 is propelled forward. As shown in FIG. 9, because the advance-reverse drive 373 (dog clutches 368, 369, 372) is shifted in the arrow BWD direction, the rear dog 372*b* of the dog clutch 372 is engaged with the dog 362*b* of the rear bevel gear 362. As described above, because the rear bevel gear 362 is rotated in the R2 direction, the dog clutch 372 is rotated in the R2 direction in the same way as the rear bevel gear 362. Accordingly, the front propeller drive shaft 363 is rotated in the R2 direction via the dog clutch 372. As a result, the front propeller 35*a* is rotated in the R2 direction as shown in FIG. 6.

Now, while referring to FIG. 6 and FIG. 9, description is made of a driving force transmission path, which transmits the driving force of the lower drive shaft 34 (engine 30) to the rear propeller drive shaft 364 in the case that the advance-reverse drive 373 (dog clutches 368, 369, 372) is shifted in the arrow BWD direction. As shown in FIG. 9, because the advance-reverse drive 373 (dog clutches 368, 369, 372) is shifted in the arrow BWD direction, the rear dog 368*b* of the dog clutch 368 is engaged with the dog 361*b* of the front bevel gear 361. In this case, the dog 369*a* of the dog clutch 369 is not engaged with the dog 378*a* of the input shaft 378. As described above, because the front bevel gear 361 is rotated in the R1 direction, the dog clutch 368 is rotated in the R1 direction in the same way as the front bevel gear 361. Accordingly, the rear propeller drive shaft 364, to which the dog clutch 368 is attached, is rotated in the R1 direction. As a result, the rear propeller 35*b* is rotated in the R1 direction as shown in FIG. 6. As shown in FIG. 9, the dog clutch 369 is not engaged with the input shaft 378 of the rear drive 374. Thus, when the advance-reverse drive 373 is shifted in the arrow BWD direction (when the boat 1 is propelled forward), the driving force of the lower drive shaft 34 (engine 30) is barely transmitted. Therefore, the driving force of the lower drive shaft 34 (engine 30) is not transmitted to the reverse drive 374.

As described above, when the advance-reverse drive 373 (dog clutches 368, 369, 372) is shifted in the arrow BWD direction, the front propeller 35*a* is rotated in the R2 direction, and the rear propeller 35*b* is rotated in the R1 direction. As a result, the boat 1 is propelled (advanced) in the arrow FWD direction.

FIG. 13 to FIG. 16 are flow charts illustrating a switch control process of the transmission, the upper clutch mechanism, and the advance-reverse drive performed by the control unit of the outboard motor according to the first preferred embodiment of the present invention. Now, while referring to FIG. 3, FIG. 7, and FIG. 13 to FIG. 16, switch operation of the transmission mechanism 32, the upper clutch mechanism 33, and the advance-reverse drive 373 of the outboard motor 3 according to the first preferred embodiment of the present invention is described in detail.

Figure 13:
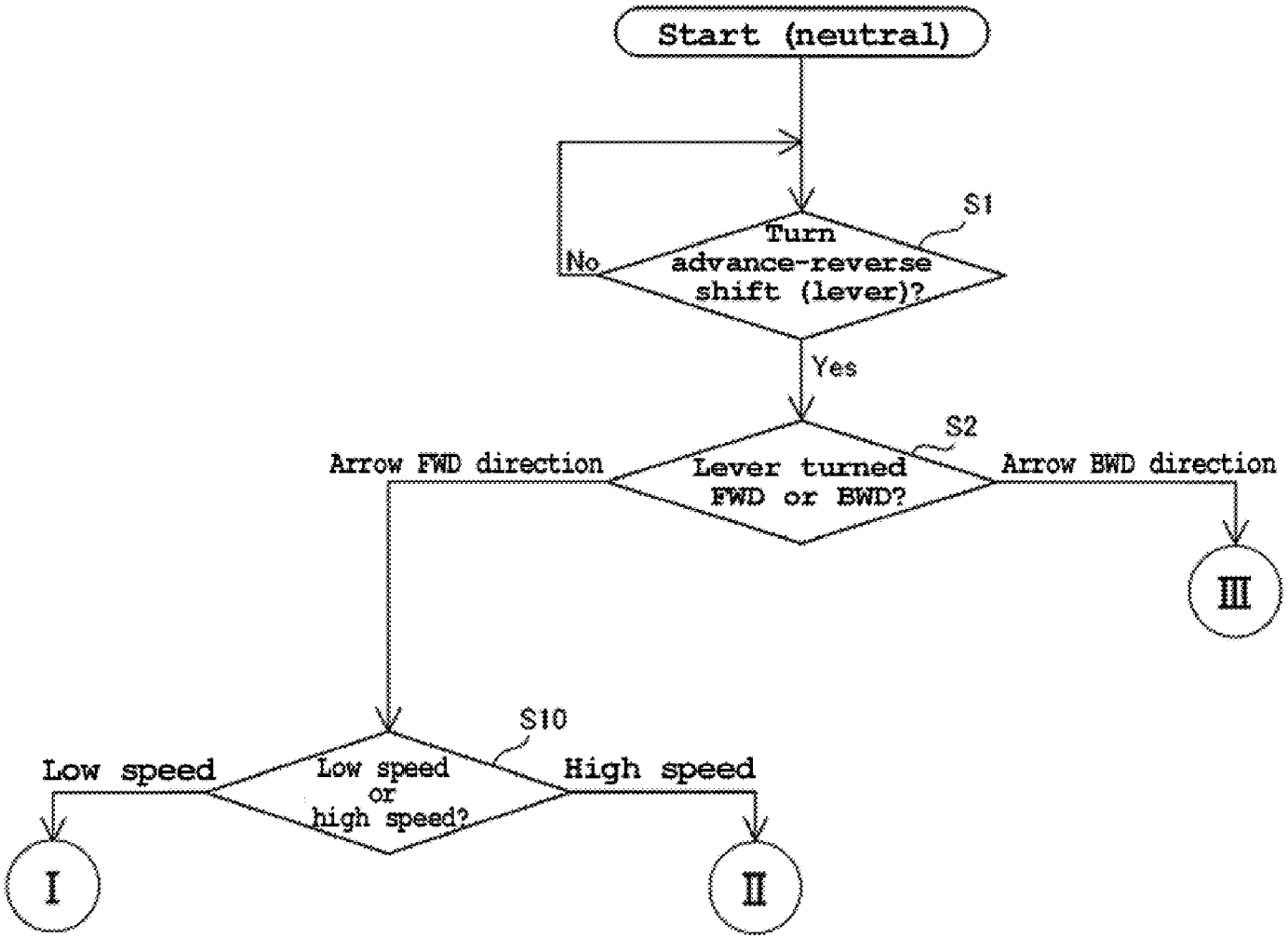
FIG. 13 is a flow chart illustrating a switch control process of the transmission mechanism, the upper clutch mechanism, and the advance-reverse drive, which are controlled by a control unit of the outboard motor according to the first preferred embodiment of the present invention.

As shown in FIG. 13, in step S1, the control unit 51 (refer to FIG. 3) determines whether the lever 5*a* of the control lever 5 is turned or not. When the lever 5*a* of the control lever 5 is determined not to be turned in step S1, the determination process of step S1 is repeated. When the lever 5*a* of the control lever 5 is determined to be turned in step S1, the process proceeds to step S2.

In step S2, the control unit 51 determines whether the lever 5*a* is turned in the arrow FWD direction (advancing direction) or turned in the arrow BWD direction (reverse direction). When the lever 5*a* is determined to be turned in the arrow FWD direction in step S2, the process proceeds to step S10. When the lever 5*a* is determined to be turned in the arrow BWD direction in step S2, the process proceeds to step S40 (refer to FIG. 16).

Now, description is made of the case that the lever 5*a* is determined to be turned in the arrow FWD direction (advancing direction) (the case that the process proceeds to step 10).

After the control unit 51 determines that the lever 5*a* is turned to the arrow FWD direction in step S2, in step S10, the control unit 51 determines which one of low-speed advance and high-speed advance the lever 5*a* is turned to or the selection button 5*b* is selecting. When the lever 5*a* or the selection button 5*b* is determined to be turned to or selecting the low-speed advance in step S10, the process proceeds to step S20 shown in FIG. 14. When the lever 5*a* or the selection button 5*b* is determined to be turned to or selecting the high-speed advance in step S10, the process proceeds to step S30 shown in FIG. 15.

Figure 14:
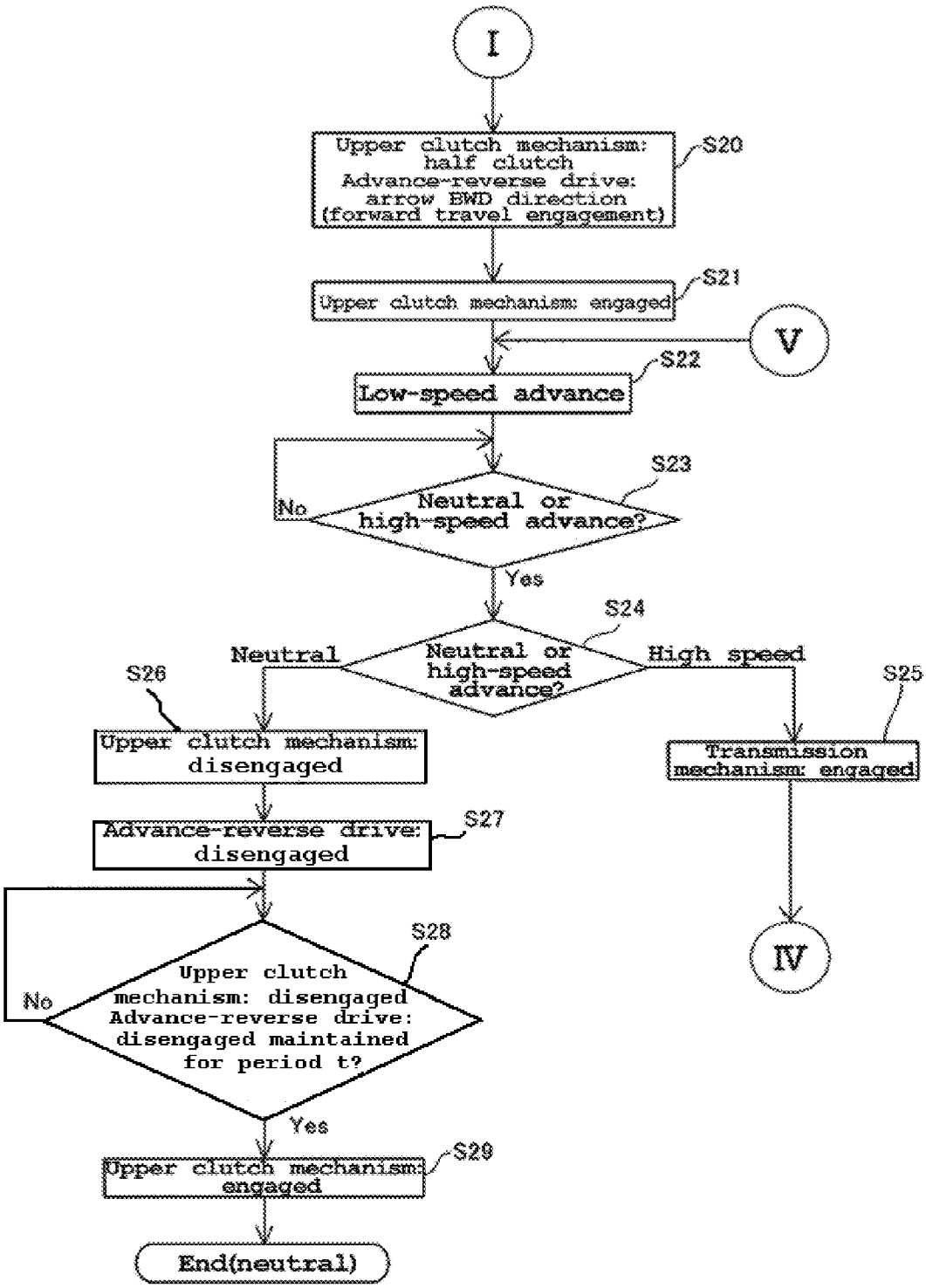
FIG. 14 is a flow chart illustrating the switch control process of the transmission mechanism, the upper clutch mechanism, and the advance-reverse drive, which are controlled by the control unit of the outboard motor according to the first preferred embodiment of the present invention.
Figure 15:
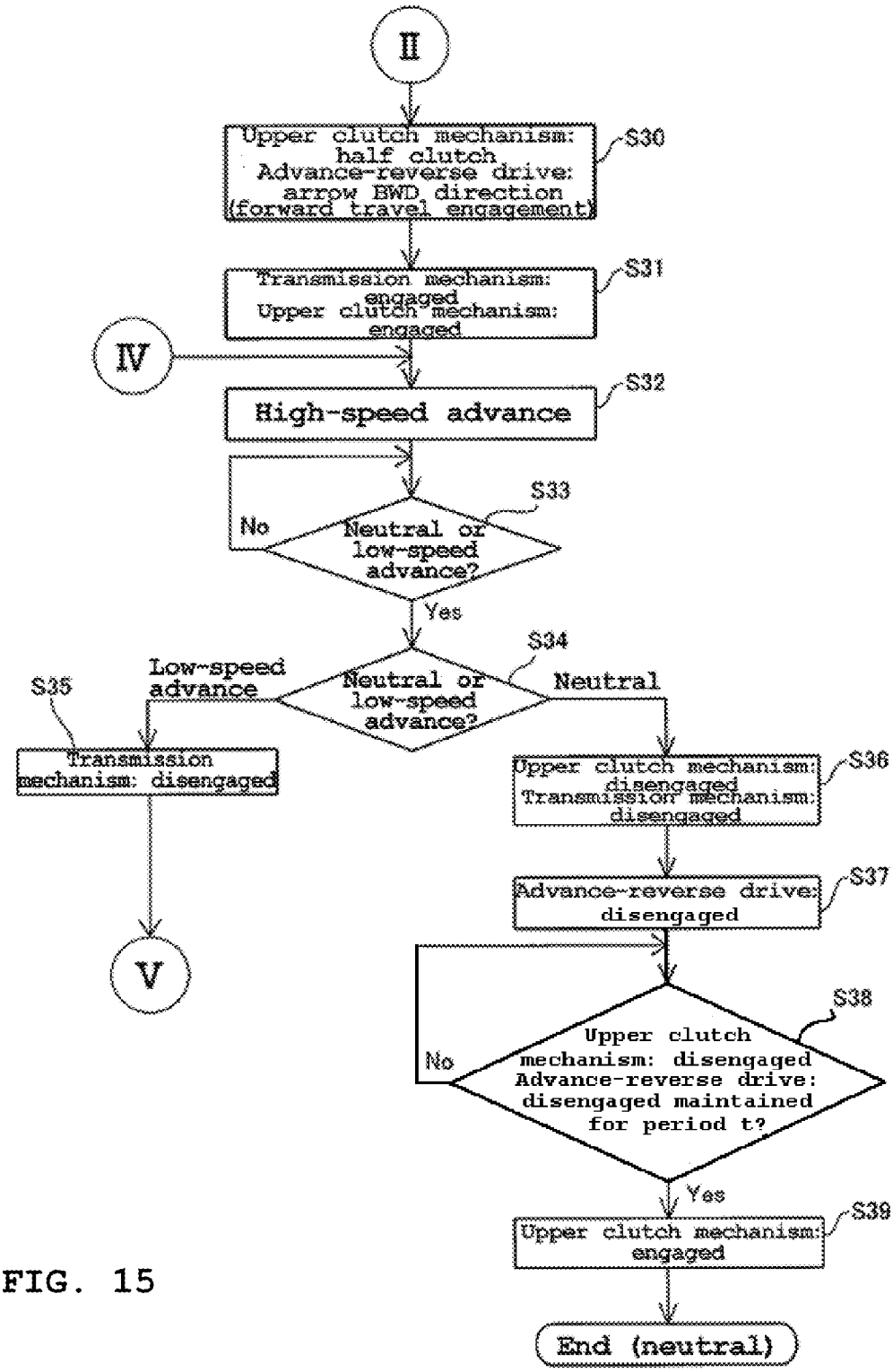
FIG. 15 is a flow chart illustrating the switch control process of the transmission mechanism, the upper clutch mechanism, and the advance-reverse drive, which are controlled by the control unit of the outboard motor according to the first preferred embodiment of the present invention.

When the lever 5*a* or the selection button 5*b* is determined to be turned to or selecting the low-speed advance in step S10 shown in FIG. 13, the control unit 51 switches the clutch 331 of the upper clutch mechanism 33 to a half clutch state (half-engaged state) in step S20 as shown in FIG. 14. Furthermore, in step S20, the control unit 51 shifts the advance-reverse drive 373 (dog clutches 368, 369, 372) to the arrow BWD direction, and the advance-reverse drive 373 is switched to a forward travel engagement state. At this time, in the first preferred embodiment, because the upper clutch mechanism 33 is engaged in a half clutch state, the rotation of the lower drive shaft 34 does not stop. Accordingly, the rotation of the front bevel gear 361 and that of the rear bevel gear 362 do not stop. Then, the dog 361*b* of the front bevel gear 361 is rotated to a position that is meshed with the rear dog 368*b* of the dog clutch 368, and the dog 362*b* of the rear bevel gear 362 is rotated to a position where the dog 362*b* is meshed with the rear dog 372*b* of the dog clutch 372.

In step S21, the clutch 331 of the upper clutch mechanism 33 is switched to an engagement state (first engagement state). In step S22, the driving force of the engine 30 is transmitted to the front propeller 35*a* and the rear propeller 35*b* in an engagement state of the low-speed advance. At this time, the upper clutch mechanism 33 is maintained in an engagement state (first engagement state), and the transmission mechanism 32 is maintained in a disengagement state. The dog clutches 368, 369, and 372 of the advance-reverse drive 373 are maintained in a forward travel engagement state in which the advance-reverse drive 373 is shifted in the arrow BWD direction.

In step S23, the control unit 51 (refer to FIG. 3) determines whether the lever 5*a* or the selection button 5*b* is turned to or selecting either one of neutral or high-speed advance. When the lever 5*a* or the selection button 5*b* is determined to be turned to or selecting neither neutral nor high-speed advance in step S23, determination in step S23 is repeated. When the lever 5*a* or the selection button 5*b* is determined to be turned or selected for either one of neutral or high-speed advance in step S23, the process proceeds to step S24.

In step S24, the control unit 51 determines which one of neutral or high-speed advance the lever 5*a* is turned in. When the lever 5*a* is determined to be turned for high-speed advance in step S24, the process proceeds to step S25. In step S25, the transmission mechanism 32 is switched to an engagement state, and the process proceeds to the step S32 (refer to FIG. 15) described later. In step S32, the driving force of the engine 30 is transmitted to the front propeller 35*a* and the rear propeller 35*b* in an engagement state of high-speed advance. When the lever 5*a* is determined to be turned to a neutral state in step S24, the process proceeds to step S26.

In step S26, the clutch 331 of the upper clutch mechanism 33 is switched to a disengagement state (first disengagement state), and the process proceeds to step S27. In step S27, the dog clutches 368, 369, and 372 of the advance-reverse drive 373 are shifted to an intermediate position, and the advance-reverse drive 373 is switched to a disengagement state (second disengagement state). Accordingly, the driving force of the engine 30 is disengaged at the clutch 331 of the upper clutch mechanism 33 and the advance-reverse drive 373, and is not transmitted to the front propeller 35*a* and the rear propeller 35*b*.

In step S28, the control unit 51 determines whether or not the clutch 331 of the upper clutch mechanism 33 and the advance-reverse drive 373 are both in the disengagement state, and whether or not the disengagement state is maintained for the certain period t (approximately 1 second). In step S28, when the control unit 51 determines that the clutch 331 of the upper clutch mechanism 33 and the advance-reverse drive 373 are both disengaged, or that the disengagement state is not maintained for the certain period t (approximately 1 second), determination in step S28 is repeated. In step S28, when the control unit 51 determines that the clutch 331 of the upper clutch mechanism 33 and the advance-reverse drive 373 are both disengaged, and that the disengagement state is maintained for the certain period t (approximately 1 second, for example), the process proceeds to step S29.

In step S29, the upper clutch mechanism 33 is switched to an engagement state (first engagement state), and switching operation of the transmission mechanism 32, the upper clutch mechanism 33, and the advance-reverse drive 373 is ended.

Now, description is made of the case that the lever 5*a* or the selection button 5*b* is determined to be turned to or selecting a high-speed advance (the case that the process proceeds to step S30).

After the control unit 51 determines that the lever 5*a* or the selection button 5*b* is turned to or selecting the high-speed advance in step S10 shown in FIG. 13, the control unit 51 switches the clutch 331 of the upper clutch mechanism 33 to the half clutch state (half-engaged state) in step S30. Furthermore, in step S30, the control unit 51 shifts the advance-reverse drive 373 (dog clutches 368, 369, 372) to the arrow BWD direction, and the advance-reverse drive 373 is switched to a forward travel engagement state. At this time, in the first preferred embodiment, the upper clutch mechanism 33 is engaged in a half clutch state, the rotation of the lower drive shaft 34 does not stop. Accordingly, the rotation of the front bevel gear 361 and that of the rear bevel gear 362 do not stop. Then, the dog 361*b* of the front bevel gear 361 is rotated to a position where the dog 361*b* is meshed with the rear dog 368*b* of the dog clutch 368, and the dog 362*b* of the rear bevel gear 362 is rotated to a position where the dog 362*b* is meshed with a rear dog 372*b* of the dog clutch 372.

In step S31, the clutch 331 of the upper clutch mechanism 33 is switched to an engagement state (first engagement state), and the transmission mechanism 32 is switched to an engagement state. In step S32, the driving force of the engine 30 is transmitted to the front propeller 35*a* and the rear propeller 35*b* in an engagement state of high-speed advance. At this time, the upper clutch mechanism 33 is maintained in an engagement state (first engagement state), and the transmission mechanism 32 is maintained in an engagement state. The dog clutches 368, 369, and 372 of the advance-reverse drive 373 are maintained in the forward travel engagement state in which the advance-reverse drive 373 is shifted in the arrow BWD direction.

In step S33, the control unit 51 (refer to FIG. 3) determines whether or not the lever 5*a* or the selection button 5*b* is turned to or selecting either neutral or low-speed advance. When the lever 5*a* or the selection button 5*b* is determined not to be turned to or selecting either neutral or low-speed advance in step S33, determination in step S33 is repeated. When the lever 5*a* or the selection button 5*b* is determined to be turned or selected for either one of neutral or high-speed advance in step S33, the process proceeds to step S34.

In step S34, the control unit 51 determines which one of neutral or low-speed advance the lever 5*a* or the selection button 5*b* is turned to or selecting. When the lever 5*a* or the selection button 5*b* is determined to be turned to or selecting low-speed advance in step S34, the process proceeds to step S35. The transmission mechanism 32 is switched to a disengagement state in step S35, and the process proceeds to step S22 described above (refer to FIG. 14). In step S22, the driving force of the engine 30 is transmitted to the front propeller 35*a* and the rear propeller 35*b* in an engagement state of low-speed advance. When the lever 5*a* or the selection button 5*b* is determined to be turned to or selecting neutral in step S34, the process proceeds to step S36.

In step S36, the clutch 331 of the upper clutch mechanism 33 is switched to a disengagement state (first disengagement state), and the transmission mechanism 32 is switched to a disengagement state. Then, the process proceeds to step S37. In step S37, the dog clutches 368, 369, and 372 of the advance-reverse drive 373 are shifted to an intermediate position, and the advance-reverse drive 373 is switched to a disengagement state (second disengagement state). Accordingly, the driving force of the engine 30 is disengaged at the clutch 331 of the upper clutch mechanism 33 and the advance-reverse drive 373 and thus is not transmitted to the front propeller 35*a* and the rear propeller 35*b*.

In step S38, the control unit 51 determines whether or not the clutch 331 of the upper clutch mechanism 33 and the advance-reverse drive 373 are both in a disengagement state, and whether or not the disengagement state is maintained for the certain period t (approximately 1 second, for example). In step S38, when the control unit 51 determines that the clutch 331 of the upper clutch mechanism 33 and the advance-reverse drive 373 are both disengaged, or that the disengagement state is not maintained for the certain period t (approximately 1 second), determination in step S38 is repeated. When the control unit 51 determines that the clutch 331 of the upper clutch mechanism 33 and the advance-reverse drive 373 are both disengaged, and that the disengagement state is maintained for the certain period t (approximately 1 second, for example) in step S38, the process proceeds to step S39.

In step S39, the upper clutch mechanism 33 is switched to an engagement state (first engagement state), and switching operation of the transmission mechanism 32, the upper clutch mechanism 33, and the advance-reverse drive 373 is terminated.

Now, description is made of the case that the lever 5*a* is determined to be turned to the arrow BWD direction (the case that the process proceeds to step S40).

Figure 16:
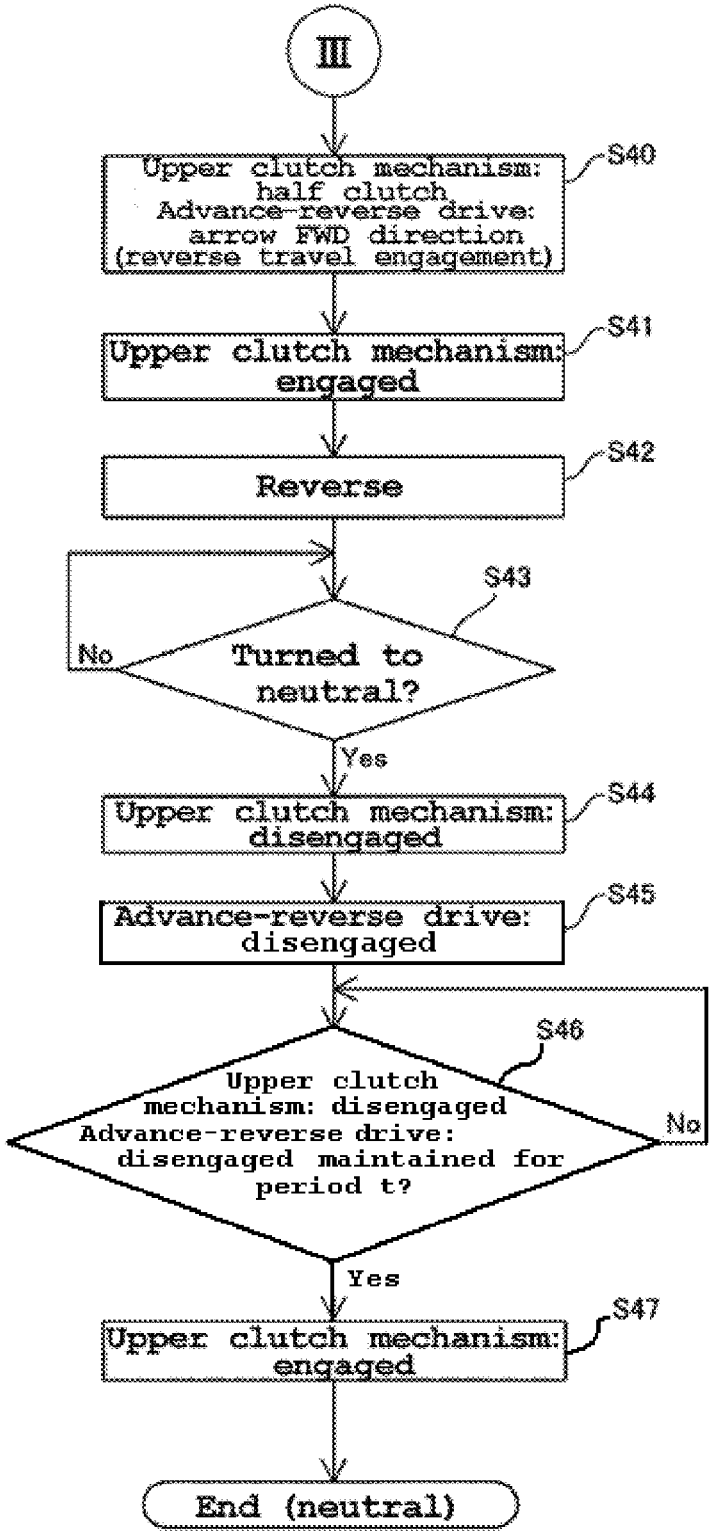
FIG. 16 is a flow chart illustrating the switch control process of the transmission mechanism, the upper clutch mechanism, and the advance-reverse drive, which are controlled by the control unit of the outboard motor according to the first preferred embodiment of the present invention.

After the control unit 51 determines that the lever 5*a* is turned to the arrow BWD direction in step 2 shown in FIG. 13, the control unit 51 switches the clutch 331 of the upper clutch mechanism 33 to a half clutch state (half-engaged state) in step S40 as shown in FIG. 16. Furthermore, in step S40, the control unit 51 shifts the advance-reverse drive 373 (dog clutches 368, 369, 372) to the arrow FWD direction, and the advance-reverse drive 373 is switched to a reverse travel engagement state. At this time, in the first embodiment, the upper clutch mechanism 33 is engaged in a half clutch state, the rotation of the lower drive shaft 34 does not stop. Accordingly, rotation of the front bevel gear 361 and that of the rear bevel gear 362 do not stop. Thus, the dog 361*c* of the front bevel gear 361 is rotated to a position where the dog 361*c* is meshed with the front dog 372*a* of the dog clutch 372, and the dog 369*a* of the dog clutch 369, which is rotated with the front bevel gear 361, is rotated to a position where the dog 369*a* is meshed with the dog 378*a* of the input shaft 378.

In step S41, the clutch 331 of the upper clutch mechanism 33 is switched to an engagement state (first engagement state). In step S42, the driving force of the engine 30 is transmitted to the front propeller 35*a* and the rear propeller 35*b* in an engagement state of reverse travel. At this time, the upper clutch mechanism 33 is maintained in an engagement state (first engagement state), and the transmission mechanism 32 is maintained in a disengagement state. The dog clutches 368, 369, and 372 of the advance-reverse drive 373 is maintained in a reverse travel engagement state, which is shifted in the arrow FWD direction.

Then, in step S43, the control unit 51 (refer to FIG. 3) determines whether or not the lever 5*a* is turned to be in a neutral state. When the control unit 51 determines that the lever 5*a* of the control lever 5 is not turned to be in a neutral state in step S43, the determination process in step S43 is repeated. When the lever 5*a* is determined to be turned into a neutral state in step S43, the process proceeds to step S44.

In step S44, the clutch 331 of the upper clutch mechanism 33 is switched to a disengagement state (first disengagement state), and the process proceeds to step S45. In step S45, the dog clutches 368, 369, and 372 of the advance-reverse drive 373 are shifted to an intermediate position, and the advance-reverse drive 373 is switched to a disengagement state (second disengagement state). Accordingly, the driving force of the engine 30 is disengaged at the clutch 331 of the upper clutch mechanism 33 and the advance-reverse drive 373, and is not transmitted to the front propeller 35*a* and the rear propeller 35*b*.

In step S46, the control unit 51 determines whether or not the clutch 331 of the upper clutch mechanism 33 and the advance-reverse drive 373 are both in a disengagement state, and whether or not the disengagement state is maintained for the certain period t (approximately 1 second). In step S46, when the control unit 51 determines that the clutch 331 of the upper clutch mechanism 33 and the advance-reverse drive 373 are both disengaged, or that the disengagement state is not maintained for the certain period t (approximately 1 second), determination in step S46 is repeated. When the control unit 51 determines that the clutch 331 of the upper clutch mechanism 33 and the advance-reverse drive 373 are both disengaged, and that the disengagement state is maintained for the certain period t (approximately 1 second, for example) in step S46, the process proceeds to step S47.

In step S47, the upper clutch mechanism 33 is switched to an engagement state (first engagement state), and switching operation of the transmission mechanism 32, the upper clutch mechanism 33, and the advance-reverse drive 373 is terminated.

In the first preferred embodiment, as described above, the advance-reverse drive 373 (dog clutches 368, 369, 372) can be controlled to be switched to an engagement state (second engagement state) while the upper clutch mechanism 33 is in a half clutch state (half-engaged state) by providing an upper clutch mechanism 33 that is constructed to be able to switch between an engagement state (first engagement state) in which the driving force of the engine 30 is transmitted to the front propeller drive shaft 363 and the rear propeller drive shaft 364, and a half-clutch state (half-engaged state) in which the driving force of the engine 30 is decreased to be transmitted; and a advance-reverse drive 373 (dog clutches 368, 369, 372) constructed to be able to switch between an engagement state (second engagement state) in which the driving force of the engine 30 to propel the boat 1 is transmitted to the front propeller 35*a* and the rear propeller 35*b*, and a disengagement state (second disengagement state) in which the driving force of the engine 30 is disengaged. Accordingly, because the advance-reverse drive 373 (dog clutches 368, 369, 372) can be switched to an engagement state (second engagement state) in a state where the driving force of the engine 30 is not substantially transmitted, a shock upon switching of an engagement state of the advance-reverse drive 373 (dog clutches 368, 369, 372) is minimized and prevented.

In the first preferred embodiment, as described above, the advance-reverse drive 373 is constructed to be able to switch an engagement state between a forward travel engagement state in which the driving force of the engine 30 can be transmitted to the front propeller 35*a* and the rear propeller 35*b* to propel the boat 1 forward, and a reverse travel engagement state in which the driving force of the engine 30 can be transmitted to the front propeller 35*a* and the rear propeller 35*b* to reverse the boat 1. Thus, a shock upon switching of an engagement state of the advance-reverse drive 373 can be minimized in a forward travel engagement state in which the advance-reverse drive 373 propels the boat 1 forward, and a shock upon switching of an engagement state of the advance-reverse drive 373 can be minimized in a reverse travel engagement state in which the advance-reverse drive 373 propels the boat 1 rearward.

In the first preferred embodiment, as described above, the advance-reverse drive 373 is constructed to be switched an engagement state to one of a forward travel engagement state and a reverse travel engagement state when the upper clutch mechanism 33 is in a half-engaged state. Thus, when the upper clutch mechanism 33 is in a half-engaged state, and when the advance-reverse drive 373 (dog clutches 368, 369, 372) is controlled to be switched to one of a forward travel engagement state and a reverse travel engagement state, switching operation of the advance-reverse drive 373 is performed while the advance-reverse drive 373 is driven to a position where the dog clutches 368, 369, and 372 are engaged, so that the advance-reverse drive 373 can be smoothly engaged. When the upper clutch mechanism 33 is in a half-engaged state, a shock upon engagement of the advance-reverse drive 373 (dog clutches 368, 369, 372) can be minimized compared to a complete engagement thereof.

In the first preferred embodiment, as described above, the boat propulsion unit is provided with the control unit 51 that controls the advance-reverse drive 373 to be switched to one of a forward travel engagement state and a reverse travel engagement state, when the upper clutch mechanism 33 is in a half-clutch state (first disengagement state and half-engaged state). Accordingly, the control unit 51 can electrically switch an engagement state of the advance-reverse drive 373 to either a forward travel engagement state or a reverse travel engagement state, when the upper clutch mechanism 33 is in a half-engaged state (first disengagement state and half-engaged state).

In the first preferred embodiment, as described above, the control unit 51 performs controls to switch the upper clutch mechanism 33 to an engagement state (first engagement state) after the elapse of the certain period t, when a disengagement state (first disengagement state) in which the upper clutch mechanism 33 disengages the driving force of the engine 30, and a disengagement state (second disengagement state) in which the advance-reverse drive 373 disengages the driving force of the engine 30 are maintained for the certain period t. Accordingly, because the upper clutch mechanism 33 is engaged after the elapse of the certain period t, the lower drive shaft 34 can be prevented from stopping for the certain period t or longer. Therefore, a unit such as the water pump 303, which is driven by the lower drive shaft 34, can be prevented from being not driven for the certain period t or longer.

In the first preferred embodiment, as described above, by employing the water pump 303 that is arranged below the upper clutch mechanism 33 and that is driven when the driving force of the engine 30 is transmitted by the upper clutch mechanism 33, the water pump 303 can pump up cooling water from a position lower than the upper clutch mechanism 33 and closer to the water surface.

In the first preferred embodiment, as described above, by employing the bevel gear 360, the front bevel gear 361, and the rear bevel gear 362 that are arranged near the lower end of the lower drive shaft 34 and that can transmit the rotation of the lower drive shaft 34 to the front propeller shaft 363 and the rear propeller drive shaft 364 at a reduced speed, the driving force of the engine 30 can be transmitted to the front propeller drive shaft 363 and the rear propeller drive shaft 364 in a state that the rotational speed of the lower drive shaft 34 is reduced. In this case, the advance-reverse drive 373 (dog clutches 368, 369, 372) can be engaged at a reduced rotational speed, so that a shock upon switching of the advance-reverse drive 373 (dog clutches 368, 369, 372) can be reduced accordingly.

Second Preferred Embodiment

Figure 17:
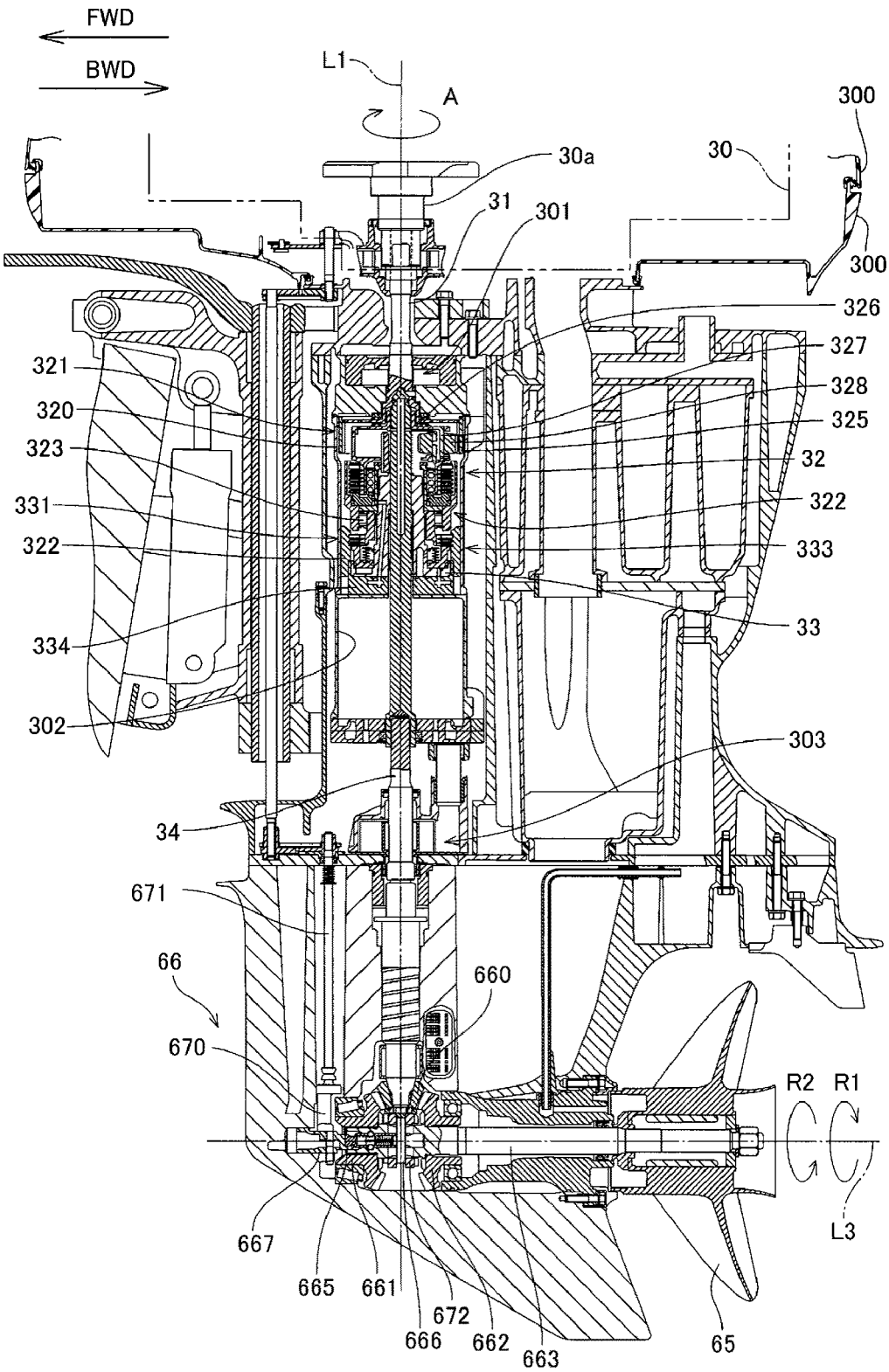
FIG. 17 is a cross-sectional view for explaining the construction of a lower mechanism of an outboard motor according to a second preferred embodiment of the present invention.
Figure 18:
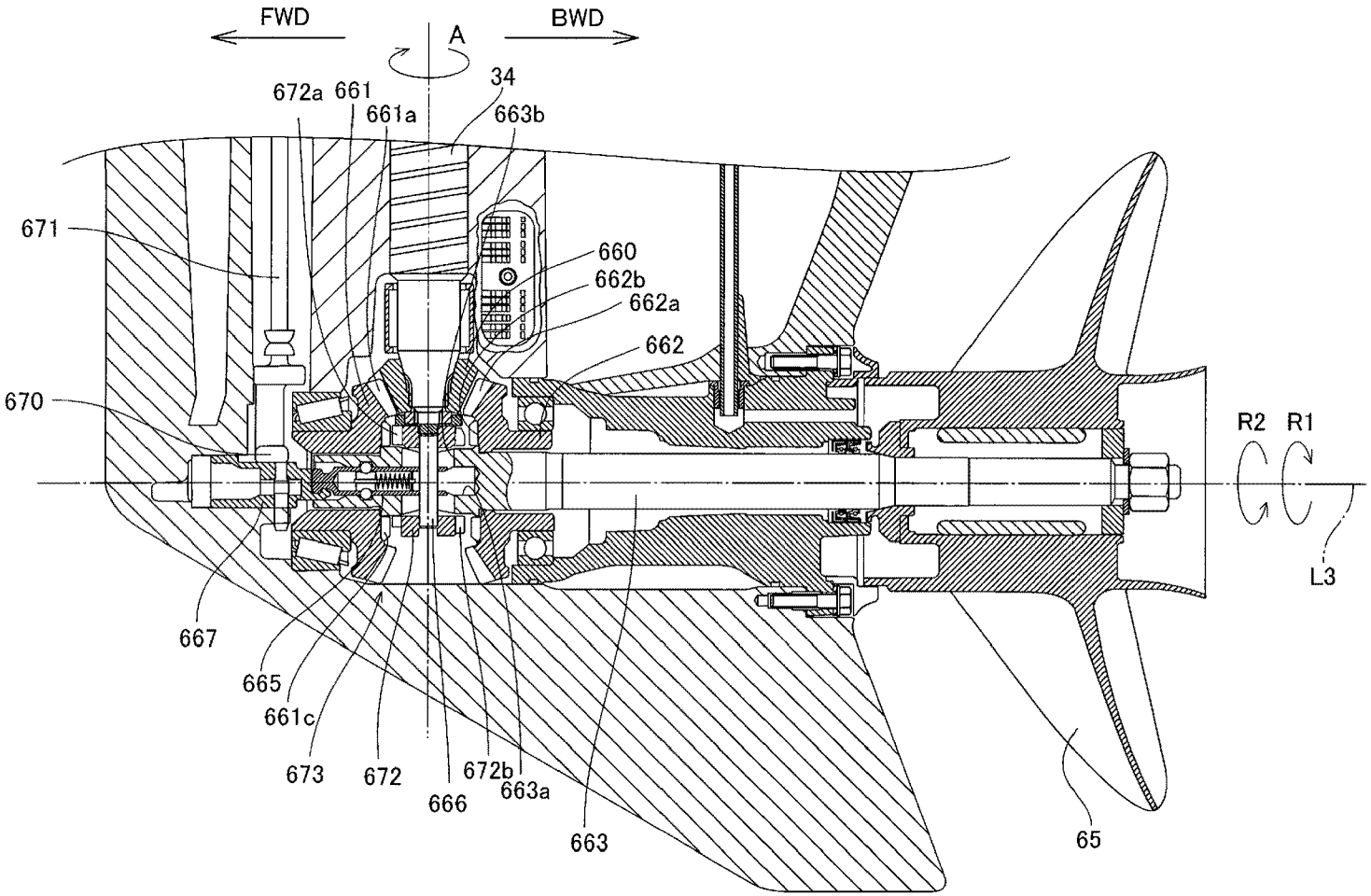
FIG. 18 is a cross-sectional view for explaining the construction of the lower mechanism of the outboard motor according to the second preferred embodiment of the present invention.

FIGS. 17 and 18 illustrate a constitution of an outboard motor according to the second preferred embodiment of the present invention. Hereinafter, construction of an outboard motor according to the second preferred embodiment of the present invention will be described in detail with reference to FIG. 3, FIG. 12, FIG. 17, and FIG. 18. In the second preferred embodiment, unlike the first preferred embodiment described above, description is made of an example in which the reverse drive is not provided with two propellers but is provided with one propeller.

In the second preferred embodiment, as shown in FIG. 17, a lower mechanism 66 is disposed below the water pump 303. A lower portion of the lower drive shaft 34 is arranged in the lower mechanism 66. A bevel gear 660 is attached to the vicinity of a lower end portion (to the bottom) of the lower drive shaft 34. The bevel gear 660 is an example of the "speed reduction portion" according to a preferred embodiment of the present invention. As shown in FIG. 18, the bevel gear 660 is meshed with a gear 661*a* of a front bevel gear 661 that is arranged below the arrow FWD, and also meshed with a gear 662*a* of a rear bevel gear 662 that is arranged below the arrow BWD. The front bevel gear 661 and the rear bevel gear 662 are examples of the "speed reduction portion" according to a preferred embodiment of the present invention. An axis L3 around which the front bevel gear 661 and the rear bevel gear 662 rotate is perpendicular or substantially perpendicular to the axis L1, around which the bevel gear rotates, and extends in the arrow FWD direction. The bevel gear 660, the front bevel gear 661, and the rear bevel gear 662 can transmit the rotation of the lower drive shaft 34 at the reduced speed to the propeller drive shaft 663 described later.

The dog 661*c*, which can engage with or separate from a dog clutch 672 described later, is disposed in a portion on the arrow BWD side of the front bevel gear 661 and on the axis L3 side of the gear 661*a*. The dog 661*c* is an example of the "engagement portion" according to a preferred embodiment of the present invention. The dog 662*b*, which can engage with or separate from a dog clutch 672 described later, is disposed in a portion on the arrow FWD side of the rear bevel gear 662 and on the axis L3 side of the gear 662*a*. The dog 662*b* is an example of the "engagement portion" according to a preferred embodiment of the present invention.

The propeller drive shaft 663, which extends in the direction perpendicular or substantially perpendicular to (intersecting with) the lower drive shaft 34, is disposed below the lower drive shaft 34. The propeller drive shaft 663 is an example of the "output shaft" according to a preferred embodiment of the present invention. The propeller drive shaft 663 is arranged to rotate about the axis L3. The propeller 65 is attached so as to be rotatable with the propeller drive shaft 663 on the arrow BWD side of the propeller drive shaft 663. On the arrow FWD side of the propeller drive shaft 663, the front bevel gear 661 and the rear bevel gear 662 are arranged so as to idle with respect to the propeller drive shaft 663. The dog clutch 672 described later is spline-fitted to the periphery between the front bevel gear 661 and the rear bevel gear 662 of the propeller drive shaft 663 so as to be slidable in the fore-and-aft direction.

An insertion hole 663*a* along the axis L3 is formed on the arrow FWD side of the propeller drive shaft 663. A through hole 663*b*, which is perpendicular or substantially perpendicular to the insertion hole 663*a*, is formed on the outer surface between the front bevel gear 661 and the rear bevel gear 662 of the propeller drive shaft 663. The through hole 663*b* is formed in the shape of a slot that extends in the fore-and-aft direction (in the arrow FWD and arrow BWD direction).

To the insertion hole 663*a* along the axis L3 of the propeller drive shaft 663, a connecting member 665 in the shape of a cylinder is inserted so as to be slidable in the fore-and-aft direction (in the arrow FWD direction and the arrow BWD direction). To a portion corresponding to the through hole 663*b* of the connecting member 665, the rod-shaped connecting member 666 is attached so as to be perpendicular or substantially perpendicular to the connecting member 665. The connecting member 666 is arranged to protrude outside from an outer surface of the propeller drive shaft 663. The connecting member 665 is slid on the through hole 663*b* in the fore-and-aft direction when the connecting member 665 is slid along the insertion hole 663*a*.

The dog clutch 672 is fixed to both ends of the connecting member 666. The dog clutch 672 is attached to an outer surface of the propeller drive shaft 663 preferably by spline-fitting in a way that the dog clutch 672 can slide with respect to the propeller drive shaft 663 and that can rotate together with the propeller drive shaft 663. That is, the dog clutch 672 is constructed to rotate together with the propeller drive shaft 663 at all times. A front dog 672*a* is disposed on the arrow FWD side end of the dog clutch 672. A rear dog 672*b* is disposed on the arrow BWD side end of the dog clutch 672. The front dog 672*a* and the rear dog 672*b* are examples of the "engagement portion" according to a preferred embodiment of the present invention. When the dog clutch 672 is slid in the arrow FWD direction, the front dog 672*a* is engaged with the dog 661*c* of the front bevel gear 661. On the other hand, when the dog clutch 672 is slid in the arrow BWD direction, the rear dog 672*b* is engaged with the dog 662*b* of the rear bevel gear 662. That is, when the dog clutch 672 is engaged with the front bevel gear 661, the rotation of the front bevel gear 661 (in the R1 direction) is directly transmitted to the propeller drive shaft 663. On the other hand, when the dog clutch 672 is engaged with the rear bevel gear 662, the rotation of the rear bevel gear 662 (in the R2 direction) is directly transmitted to the propeller drive shaft 663. When the dog clutch 672 is in an intermediate position where the dog clutch 672 is engaged with neither the front bevel gear 661 nor the rear bevel gear 662, driving force of the bevel gear 660 is not transmitted to the propeller drive shaft 663.

In the second preferred embodiment, the advance-reverse drive 673 is constituted by the connecting members 665, 666 and the dog clutch 672. The advance-reverse drive 673 is arranged on the axis L3 and driven during forward travel and reverse travel of the boat 1.

A moving member 667 is attached to the connecting member 665 on the arrow FWD side. The moving member 667 is movable in the fore-and-aft direction (in the arrow FWD direction and the arrow BWD direction). The connecting member 665 is movable in the fore-and-aft direction along with the motion of the moving member 667 in the fore-and-aft direction. An advance-reverse switching lever 670 is engaged with the moving member 667. The advance-reverse switching lever 670 is constructed to turn about a linkage 671, and engaged with the moving member 667 in a place apart from the rotation center of the linkage 671. The moving member 667 is moved in the fore-and-aft direction along with the turning of the advance-reverse switching lever 670. In the second preferred embodiment, as shown in FIG. 17, the linkage 671 is connected to an actuator (not shown) arranged in the case 300. The advance-reverse switching lever 670 is turned by drive of the actuator (not shown) based on a positional signal of the lever 5*a* (refer to FIG. 3) that is transmitted by the control unit 51 (refer to FIG. 3).

In the second preferred embodiment, as shown in FIG. 18, when the dog clutch 672 is shifted in the arrow FWD direction, the advance-reverse drive 673 is shifted to a reverse travel engagement state (second engagement state) in which the advance-reverse drive 673 can transmit the driving force of the engine 30 to the propeller 65 in order to reverse (propel) the boat 1. On the other hand, when the dog clutch 672 is shifted in the arrow BWD direction, the advance-reverse drive 673 is shifted to a forward travel engagement state (second engagement state) in which the advance-reverse 673 can transmit the driving force of the engine 30 to the propeller 65 to advance (propel) the boat 1. When the dog clutch 672 is shifted to a neutral position where the dog clutch 672 is not engaged with any of the dogs, the advance-reverse drive 673 is shifted to a disengagement state (2nd disengagement state) in which the driving force of the engine 30 is disengaged. That is, as shown in FIG. 12, the advance-reverse drive 673 in the second preferred embodiment can switch an engagement state between a forward engagement state and a reverse travel engagement state only through a neutral state (second disengagement state) in the same way as the advance-reverse drive 373 according to the first preferred embodiment.

In the second preferred embodiment, the dog clutch 672 of the advance-reverse drive 673 can switch an engagement state to either a forward travel engagement state (second engagement state) or a reverse travel engagement state (second engagement state) when the upper clutch mechanism 33 is in a half clutch state (half-engaged state). Specifically, when the user turns the lever 5*a* (refer to FIG. 3) from a neutral state to the arrow FWD direction or the arrow BWD direction, the control unit 51 (refer to FIG. 3) controls the upper clutch mechanism 33 (refer to FIG. 17) to be shifted to a half clutch state (half-engaged state), and also controls the dog clutch 672 to be shifted to the arrow BWD direction or the arrow FWD direction. When the disengagement state (first disengagement state) in which the clutch 331 of the upper clutch mechanism 33 disengages the driving force of the engine 30, and the disengagement state (second disengagement state) in which the dog clutch 672 of the advance-reverse drive 673 disengages the driving force of the engine 30 are maintained for the certain period t (approximately 1 second, for example), the control unit 51 performs control to switch the clutch 331 of the upper clutch mechanism 33 to the engagement state (first engagement state) after the elapse of the certain period t.

Other constructions of the second preferred embodiment are preferably the same as those of the first preferred embodiment.

Now, while referring to FIG. 18, description is made of a driving force transmission path that transmits the driving force of the lower drive shaft 34 (engine 30) to the propeller drive shaft 663 in the case that the advance-reverse drive 673 (dog clutch 672) is shifted in the arrow FWD direction when the boat 1 is propelled in reverse. As shown in FIG. 18, because the advance-reverse drive 673 (dog clutch 672) is shifted in the arrow FWD direction, the front dog 672*a* of the dog clutch 672 is engaged with the dog 661*c* of the front bevel gear 661. Accordingly, rotation of the front bevel gear 661 in the R1 direction is transmitted to the dog clutch 672, and the dog clutch 672 is rotated in the R1 direction. Because the dog clutch 672 is attached to the front propeller drive shaft 663, the propeller drive shaft 663 is rotated in the R1 direction. As a result, the propeller 65 is rotated in the R1 direction. At this time, the rear dog 672*b* of the dog clutch 672 is not engaged with the dog 662*b* of the rear bevel gear 662. Thus, the rear bevel gear 662 idles with respect to the propeller drive shaft 663. That is, rotation of the rear bevel gear 662 in the R2 direction is not transmitted to the propeller drive shaft 663.

Now, description is made of a driving force transmission path that transmits the driving force of the lower drive shaft 34 (engine 30) to the propeller drive shaft 663 in the case that the advance-reverse drive 673 (dog clutch 672) is shifted in the arrow BWD direction when the boat 1 is propelled forward. Because the advance-reverse drive 673 (dog clutch 672) is shifted in the arrow BWD direction, the rear dog 672*b* of the dog clutch 672 is engaged with the dog 662*b* of the rear bevel gear 662. As described above, because the rear bevel gear 662 is rotated in the R2 direction, the dog clutch 672 is rotated in the R2 direction in the same way as the rear bevel gear 662. Accordingly, the propeller drive shaft 663 is rotated in the R2 direction via the dog clutch 672. As a result, the propeller 65 is rotated in the R2 direction.

In the second preferred embodiment, as described above, the advance-reverse drive 373 (dog clutches 368, 369, 372) can be controlled to switch to an engagement state (second engagement state) while the upper clutch mechanism 33 is in a half clutch state (half-engaged state) by disposing: an upper clutch mechanism 33 that can be switched between an engagement state (first engagement state) in which the driving force of the engine 30 is transmitted to the propeller drive shaft 663, and a half-clutch state (half-engaged state) in which the driving force of the engine 30 is decreased to be transmitted (half-engaged state); and the advance-reverse drive 373 (dog clutches 368, 369, 372) that can be switched between an engagement state (second engagement state) in which the driving force of the engine 30 to propel the boat 1 is transmitted to the propeller 65, and a disengagement state (second disengagement state), in which the driving force of the engine 30 is disengaged. Accordingly, since the advance-reverse drive 673 (dog clutch 672) can be switched to an engagement state (second engagement state) in a state where the driving force of the engine 30 is not substantially transmitted to the advance-reverse drive 673 (dog clutch 672), a shock upon switching of an engagement state of the advance-reverse drive 673 (dog clutch 672) can be reduced.

It should be understood that the preferred embodiments disclosed herein is illustrative in all respects and not restrictive. The scope of the present invention is intended to be defined not by the above description of the preferred embodiments but by the claims and to include all equivalents and modifications of the claims.

For example, in the first and second preferred embodiments, description is made of the boat propulsion unit that preferably includes the two outboard motors in which the engine and the propeller are arranged outside of the hull as an exemplary case. However, the present invention is not limited to this case, but can be applied to other boat propulsion units that include a stern drive in which an engine is fixed to a hull, an inboard motor in which an engine and a propeller are fixed to a hull, and so forth.

In the first and second preferred embodiments described above, description is made of the example in which the outboard motor preferably includes one propeller, and of the example in which the outboard motor preferably includes two propellers. However, the present invention is not limited to these examples. The outboard motor according to the present invention may include three or more propellers.

In the first and the second preferred embodiments, description is made of the example in which the plurality of dogs of the advance-reverse drive are preferably engaged in a state that the upper clutch mechanism is engaged in a half clutch state. However, the present invention is not limited to this. The plurality of dogs of the advance-reverse drive may be engaged in a state that the upper clutch mechanism is completely disengaged (first disengagement state). When the advance-reverse drive is switched in a state that the upper clutch mechanism is completely disengaged, a shock reduction effect upon engagement of the dog of the advance-reverse drive is further significant.

In the first and the second preferred embodiments, description is made of the example in which the transmission mechanism, the upper clutch mechanism, and advance-reverse drive are preferably controlled by the control unit of the control lever. However, the present invention is not limited to this. The transmission mechanism, the upper clutch mechanism, and the advance-reverse drive may be controlled by an engine control unit (ECU) that controls the engine or may be controlled by both of the control unit of the control lever and the engine control unit (ECU).

In the first and the second preferred embodiments, description is made of an example in which the upper clutch mechanism is arranged below the transmission mechanism. However, the present invention is not limited to this. The upper clutch mechanism may be arranged above the transmission mechanism. The upper clutch mechanism may be disposed in the vicinity of a bottom portion of the lower drive shaft, which is below the water pump, for example.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

an engine;

a drive shaft arranged below the engine;

an output shaft arranged below the drive shaft and extending in a direction intersecting with the drive shaft;

a propeller disposed on the output shaft and arranged to rotate together with the output shaft;

a first clutch mechanism arranged on an axis of the drive shaft and arranged to switch an engagement state between a first engagement state in which a driving force of the engine is transmitted to the output shaft, and at least one of a half-engaged state in which only a portion of the driving force of the engine transmitted in the first engagement state is transmitted to the output shaft, and a first disengagement state in which the driving force of the engine is completely disengaged; and a second clutch mechanism arranged on an axis of the output shaft, and arranged to switch an engagement state between a second engagement state in which the driving force of the engine is transmitted to the propeller in order to propel the boat forward and a second disengagement state in which the driving force of the engine is disengaged; wherein the second engagement state of the second clutch mechanism includes a forward travel engagement state in which the driving force of the engine can be transmitted to the propeller in order to propel the boat forward, and a reverse travel engagement state in which the driving force of the engine can be transmitted to the propeller in order to reverse the boat; and the second clutch mechanism is arranged to switch the engagement state to either the forward travel engagement state or the reverse travel engagement state when the first clutch mechanism is in the half-engaged state.

2. The boat propulsion unit according to claim 1, wherein the first clutch mechanism includes plate members arranged to contact each other, and a plate clutch arranged to switch the engagement state to the first engagement state or the half-engaged state; and the second clutch mechanism includes a plurality of engagement portions and a dog clutch arranged to switch the engagement state to the second engagement state when the plurality of engagement portions are engaged.

3. The boat propulsion unit according to claim 1, further comprising a control unit arranged to control the second clutch mechanism to switch the engagement state to either the forward travel engagement state or the reverse travel engagement state when the first clutch mechanism is in either the first disengagement state or the half-engaged state.

4. A boat propulsion unit comprising:

an engine;

a drive shaft arranged below the engine;

an output shaft arranged below the drive shaft and extending in a direction intersecting with the drive shaft;

a propeller disposed on the output shaft and arranged to rotate together with the output shaft;

a first clutch mechanism arranged on an axis of the drive shaft and arranged to switch an engagement state between a first engagement state in which a driving force of the engine is transmitted to the output shaft, and at least one of a half-engaged state in which only a portion of the driving force of the engine transmitted in the first engagement state is transmitted to the output shaft, and a first disengagement state in which the driving force of the engine is completely disengaged; and a second clutch mechanism arranged on an axis of the output shaft, and arranged to switch an engagement state between a second engagement state in which the driving force of the engine is transmitted to the propeller in order to propel the boat forward and a second disengagement state in which the driving force of the engine is disengaged; wherein when the first disengagement state in which the first clutch mechanism disengages the driving force of the engine, and the second disengagement state in which the second clutch mechanism disengages the driving force of the engine are both maintained for a predetermined period of time, the control unit is arranged to perform a control to switch the engagement state of the first clutch mechanism to the first engagement state after an elapse of the predetermined period of time.

5. The boat propulsion unit according to claim 4, further comprising a water pump arranged between the first clutch mechanism and the second clutch mechanism, and arranged to be driven when the driving force of the engine is transmitted by the first clutch mechanism.

6. The boat propulsion unit according to claim 1, further comprising a transmission mechanism arranged on an axis of the drive shaft and arranged to transmit the driving force of the engine to the output shaft in a state where a speed of the driving force of the engine is changed at least with a low speed reduction ratio or a high speed reduction ratio; wherein the first clutch mechanism is arranged below the transmission mechanism.

7. The boat propulsion unit according to claim 1, wherein the output shaft includes:

a first output shaft arranged to rotate in a first direction when the boat is propelled forward, and to rotate in a second direction opposite to the first direction when the boat is propelled in reverse; and a second output shaft arranged to rotate in the second direction when the boat is propelled forward, and to rotate in the first direction when the boat is propelled in reverse; wherein the propeller includes a first propeller that is disposed on the first output shaft and a second propeller that is disposed on the second output shaft; and a rotational direction of the first output shaft and a rotational direction of the second output shaft during forward travel or reverse travel of the boat is switched by the second clutch mechanism.

8. The boat propulsion unit according to claim 1, further comprising a speed reduction portion arranged near a bottom end of the drive shaft and arranged to transmit rotation of the drive shaft at a reduced speed to the output shaft.

9. The boat propulsion unit according to claim 4, further comprising a transmission mechanism arranged on an axis of the drive shaft and arranged to transmit the driving force of the engine to the output shaft in a state where a speed of the driving force of the engine is changed at least with a low speed reduction ratio or a high speed reduction ratio; wherein the first clutch mechanism is arranged below the transmission mechanism.

10. The boat propulsion unit according to claim 4, wherein the output shaft includes:

a first output shaft arranged to rotate in a first direction when the boat is propelled forward, and to rotate in a second direction opposite to the first direction when the boat is propelled in reverse; and a second output shaft arranged to rotate in the second direction when the boat is propelled forward, and to rotate in the first direction when the boat is propelled in reverse; wherein the propeller includes a first propeller that is disposed on the first output shaft and a second propeller that is disposed on the second output shaft; and a rotational direction of the first output shaft and a rotational direction of the second output shaft during forward travel or reverse travel of the boat is switched by the second clutch mechanism.

11. The boat propulsion unit according to claim 4, further comprising a speed reduction portion arranged near a bottom end of the drive shaft and arranged to transmit rotation of the drive shaft at a reduced speed to the output shaft.

* * * * *